US007621760B1

(12) United States Patent
Barr et al.

(10) Patent No.: US 7,621,760 B1
(45) Date of Patent: Nov. 24, 2009

(54) ELECTRICAL CONNECTOR

(75) Inventors: Alexander W. Barr, Austin, TX (US); William J. Lee, Leander, TX (US); Charles F. Staley, Lakeway, TX (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 12/334,301

(22) Filed: Dec. 12, 2008

Related U.S. Application Data

(60) Provisional application No. 61/083,283, filed on Jul. 24, 2008.

(51) Int. Cl.
*H01R 12/00* (2006.01)

(52) U.S. Cl. ..... 439/79; 439/607.05; 439/941

(58) Field of Classification Search ..... 439/79, 439/607.05–607.09, 941
See application file for complete search history.

(56) References Cited

U.S. PATENT DOCUMENTS

| | | | |
|---|---|---|---|
| 4,686,607 | A | 8/1987 | Johnson |
| 5,620,340 | A | 4/1997 | Andrews |
| 5,775,947 | A | 7/1998 | Suzuki et al. |
| 6,146,202 | A | 11/2000 | Ramey et al. |
| 6,231,391 | B1 | 5/2001 | Ramey et al. |
| 6,371,813 | B2 | 4/2002 | Ramey et al. |
| 6,478,624 | B2 | 11/2002 | Ramey et al. |
| 6,527,587 | B1 | 3/2003 | Ortega et al. |
| 2005/0191907 | A1 | 9/2005 | Scherer et al. |

FOREIGN PATENT DOCUMENTS

EP 1 049 201 A1 11/2000

OTHER PUBLICATIONS

Product Literature: 3M UHM Backplane Connector, 3M Electronic Solutions Division, "Interconnect Solutions," (2007),13 pages.
Product Literature: Z-Pack Slim UHD Connector Platform, Tyco Electronics, Catalog 1654261-5, (2008),8 pages.
News Release: Eppensteiner et al., "Z-Pack Slim Ultra High Density (UHD) Connectors Meet Demands for Higher Signal Density," Tyco Electronics, Mar. 27, 2008, 2 pages.
Drawing: 3M Product Drawing 78-9100-5988-6.

*Primary Examiner*—Khiem Nguyen
(74) *Attorney, Agent, or Firm*—Johannes P. M. Kusters

(57) ABSTRACT

An electrical connector includes a header connector and a socket connector configured to mate with the header connector. The header connector includes a plurality of signal pins and a plurality of shield blades. The socket connector includes a plurality of conductive paths, each conductive path being coupled to a signal contact, and a plurality of first shields. The plurality of signal pins and the plurality of conductive paths and signal contacts are configured to form a plurality of transmission lines. The plurality of shield blades and the plurality of first shields are electrically connected and configured to provide interrupted shielding of the plurality of transmission lines when the header connector and the socket connector are in a mated configuration.

20 Claims, 20 Drawing Sheets

ELECTRICAL CONNECTOR

CROSS REFERENCE TO RELATED APPLICATION

This application claims the benefit of U.S. Provisional Patent Application No. 61/083,283, filed Jul. 24, 2008, the disclosure of which is incorporated by reference herein in its entirety.

TECHNICAL FIELD

The present invention relates to two-part electrical connectors. In particular, the present invention relates to two-part high speed electrical connectors for attachment to printed circuit boards and/or electrical cables in, e.g., backplane applications.

BACKGROUND

Conductors carrying high frequency signals and currents are subject to interference and crosstalk when placed in close proximity to other conductors carrying high frequency signals and currents. This interference and crosstalk can result in signal degradation and errors in signal reception. Coaxial and shielded cables are available to carry signals from a transmission point to a reception point, and reduce the likelihood that the signal carried in one shielded or coaxial cable will interfere with the signal carried by another shielded or coaxial cable in close proximity. However, at points of connection, the shielding is often lost, thereby allowing interference and crosstalk between signals. The use of individual shielded wires and cables is not desirable at points of connections due to the need for making a large number of connections in a very small space. In these circumstances, two-part high speed electrical connectors containing multiple shielded transmission lines are used. Specification IEC 61076-4-101 from the International Electrotechnical Commission sets out parameters for 2 mm, two-part connectors for use with printed circuit boards.

As users modify and upgrade systems to achieve improved performance, problems related to backward compatibility arise between, for example, CompactPCI or FutureBus connectors and modern high speed shielded connectors. This means that users wishing to upgrade their system performance by changing to a shielded connector system must upgrade both connector elements (header and socket components) and perhaps additionally change the overall packaging of their system. An electrical connector that provides an increase in performance, while still permitting backwards compatibility with, for example, CompactPCI or FutureBus connectors is desirable.

SUMMARY

At least one aspect of the present invention pertains to a two-part electrical connector for attachment to printed circuit boards and/or electrical cables and designed to provide an increase in performance over electrical connectors currently known in the art, while still permitting backwards compatibility with, for example, CompactPCI or FutureBus connectors.

In one aspect, the present invention provides an electrical connector including a header connector and a socket connector configured to mate with the header connector. The header connector includes a header body formed to include a plurality of first openings and a plurality of second openings. The header connector further includes a plurality of signal pins configured for insertion into the plurality of first openings, and a plurality of shield blades configured for insertion into the plurality of second openings. The socket connector includes a socket housing, a plurality of connector modules, and a plurality of first shields. The plurality of connector modules are configured for insertion into the socket housing. Each connector module includes an insulating material encasing a plurality of conductive paths. Each conductive path is coupled to a signal contact. The plurality of first shields are configured for insertion into the socket housing. Each first shield extends along a first side of an associated connector module. The plurality of signal pins and the plurality of conductive paths and signal contacts are configured to form a plurality of transmission lines. The plurality of shield blades and the plurality of first shields are electrically connected and configured to provide interrupted shielding of the plurality of transmission lines when the header connector and the socket connector are in a mated configuration.

In another aspect, the present invention provides a header connector including a header body, a plurality of signal pins, and a plurality of shield blades. The header body is formed to include a plurality of first openings and a plurality of second openings. The plurality of signal pins are configured for insertion into the plurality of first openings. The plurality of shield blades are configured for insertion into the plurality of second openings. The plurality of signal pins are configured to cooperate with a plurality of conductive paths and signal contacts of a mating socket connector to form a plurality of transmission lines. The plurality of shield blades are configured to be electrically grounded and provide interrupted shielding of the plurality of transmission lines when the header connector and the socket connector are in a mated configuration. The plurality of shield blades extend into the socket connector when the header connector and the socket connector are in a mated configuration.

In another aspect, the present invention provides a socket connector including a socket housing, a plurality of connector modules, and a plurality of first shields. The plurality of connector modules are configured for insertion into the socket housing. Each connector module includes an insulating material encasing a plurality of conductive paths. Each conductive path is coupled to a signal contact. The plurality of first shields are configured for insertion into the socket housing. Each first shield extends along a first side of an associated connector module. The plurality of conductive paths and signal contacts are configured to cooperate with a plurality of signal pins of a mating header connector to form a plurality of transmission lines. The plurality of first shields are configured to be electrically grounded and provide interrupted shielding of the plurality of transmission lines when the socket connector and the header connector are in a mated configuration.

The above summary of the present invention is not intended to describe each disclosed embodiment or every implementation of the present invention. The Figures and detailed description that follow below more particularly exemplify illustrative embodiments.

DETAILED DESCRIPTION

In the following detailed description of the preferred embodiments, reference is made to the accompanying drawings that form a part hereof. The accompanying drawings show, by way of illustration, specific embodiments in which the invention may be practiced. It is to be understood that other embodiments may be utilized, and structural or logical changes may be made without departing from the scope of the present invention. The following detailed description, therefore, is not to be taken in a limiting sense, and the scope of the invention is defined by the appended claims.

Figure 1A:
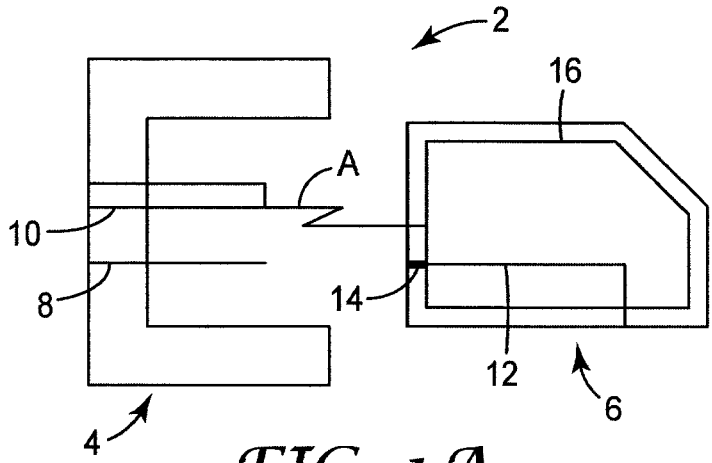
FIGS. 1A-1E are schematic representations of exemplary embodiments of an electrical connector according to an aspect of the present invention.
Figure 1B:
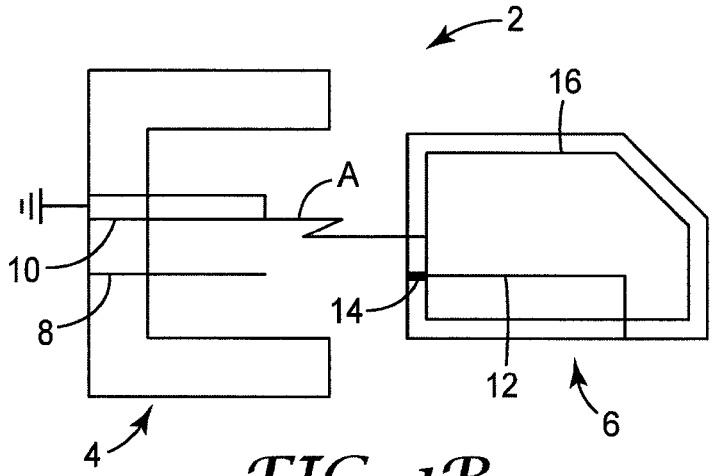
Figure 1C:
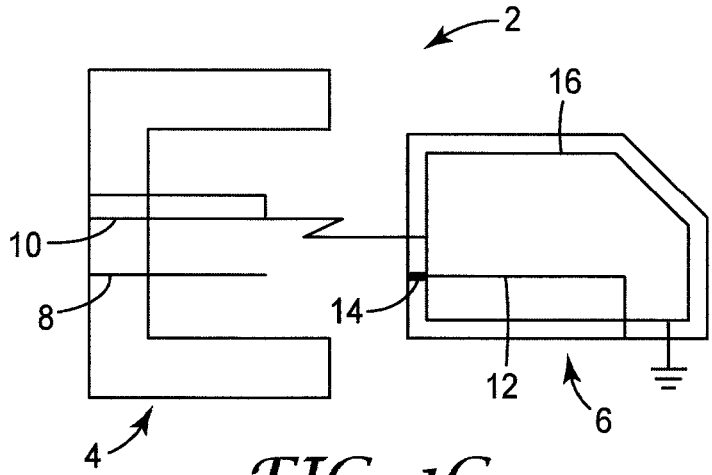
Figure 1D:
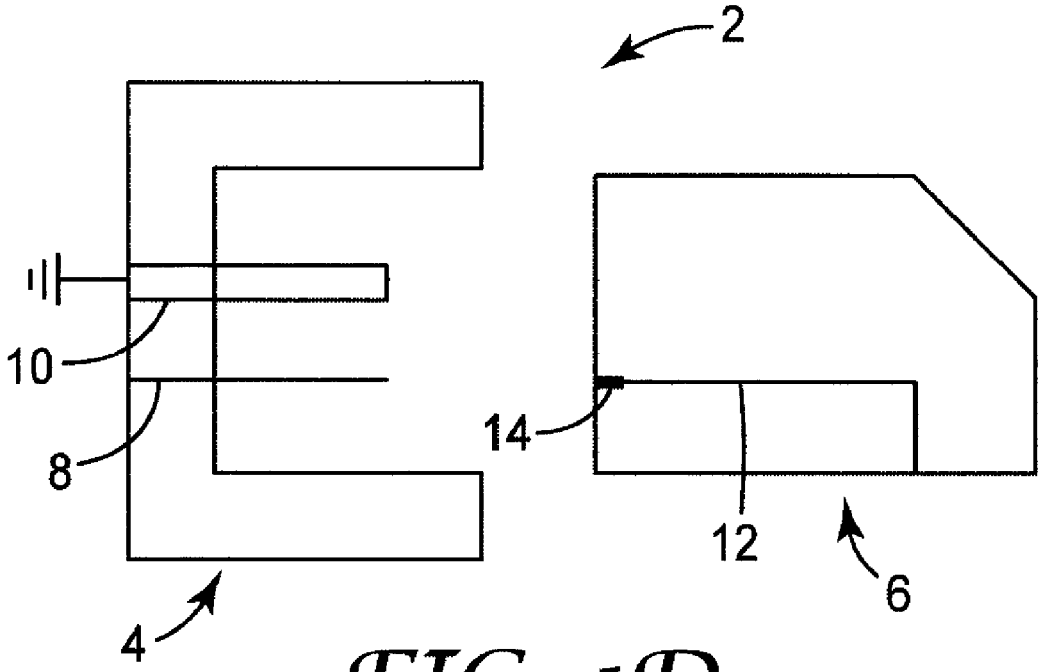
Figure 1E:
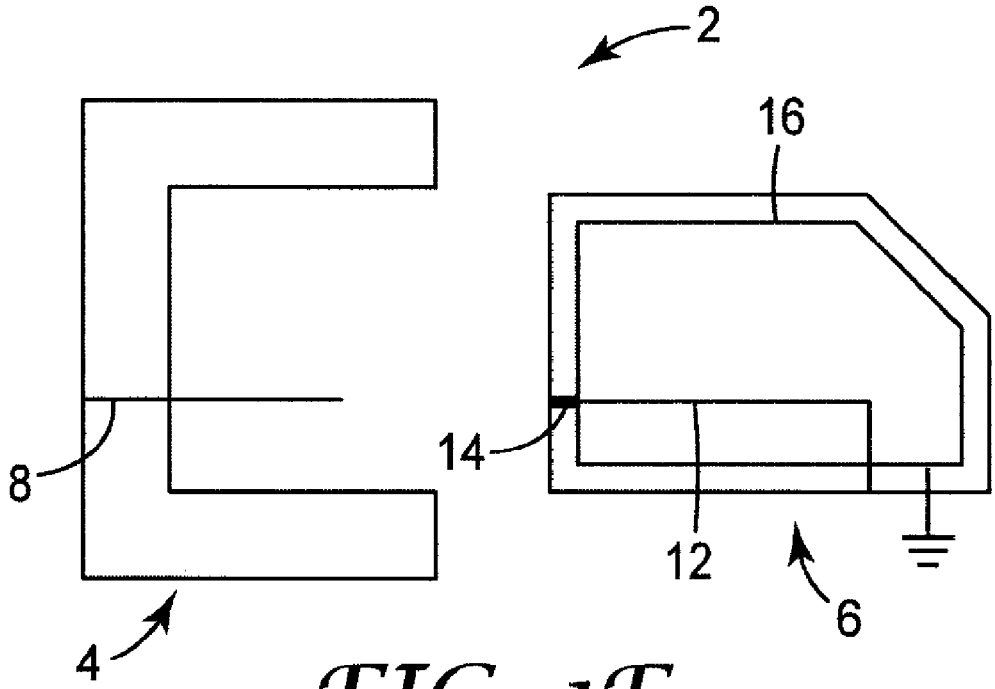
Figure 2:
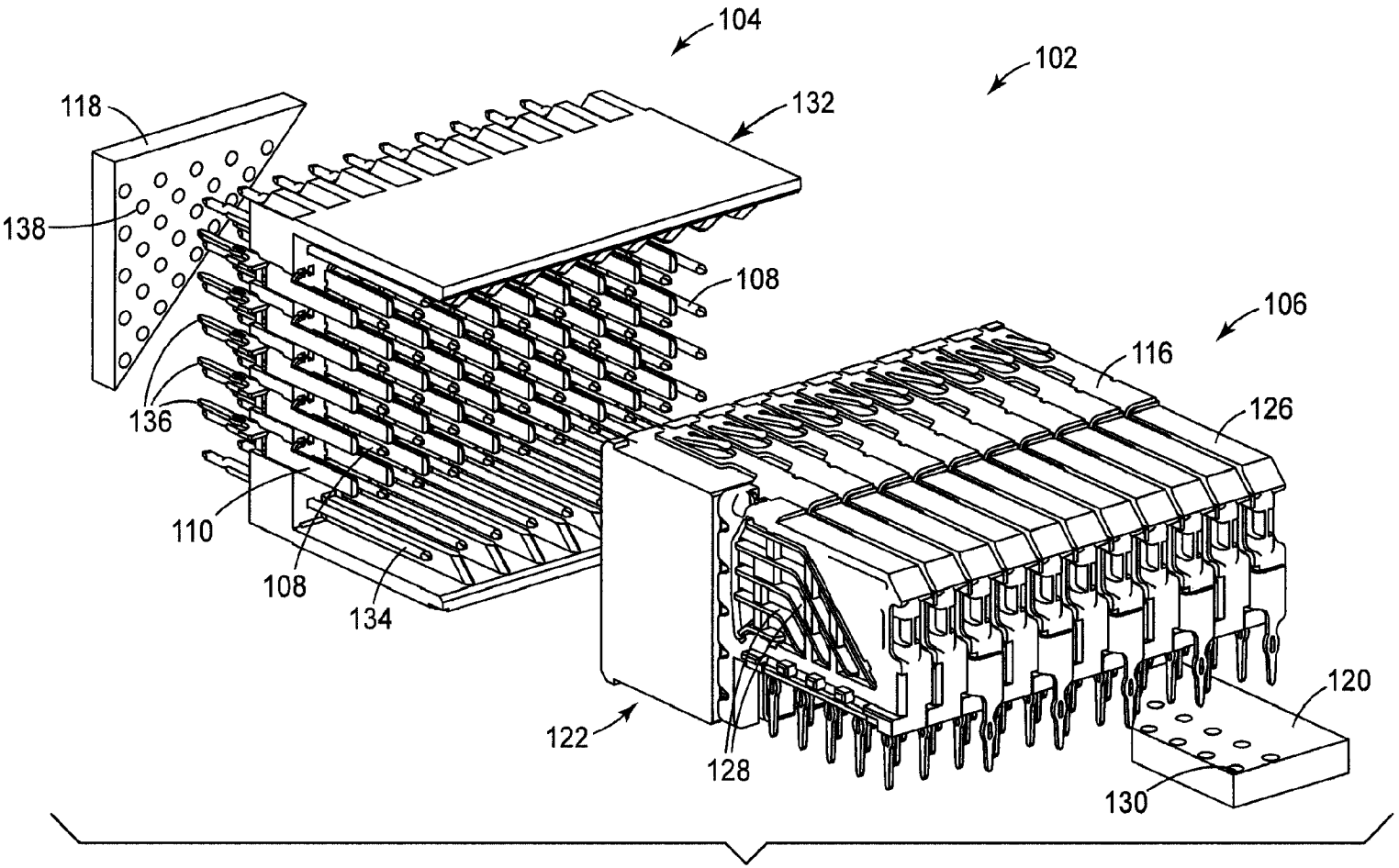
FIG. 2 is a perspective exploded view of an exemplary embodiment of an electrical connector according to an aspect of the present invention including a socket connector and a header connector.
Figure 3:
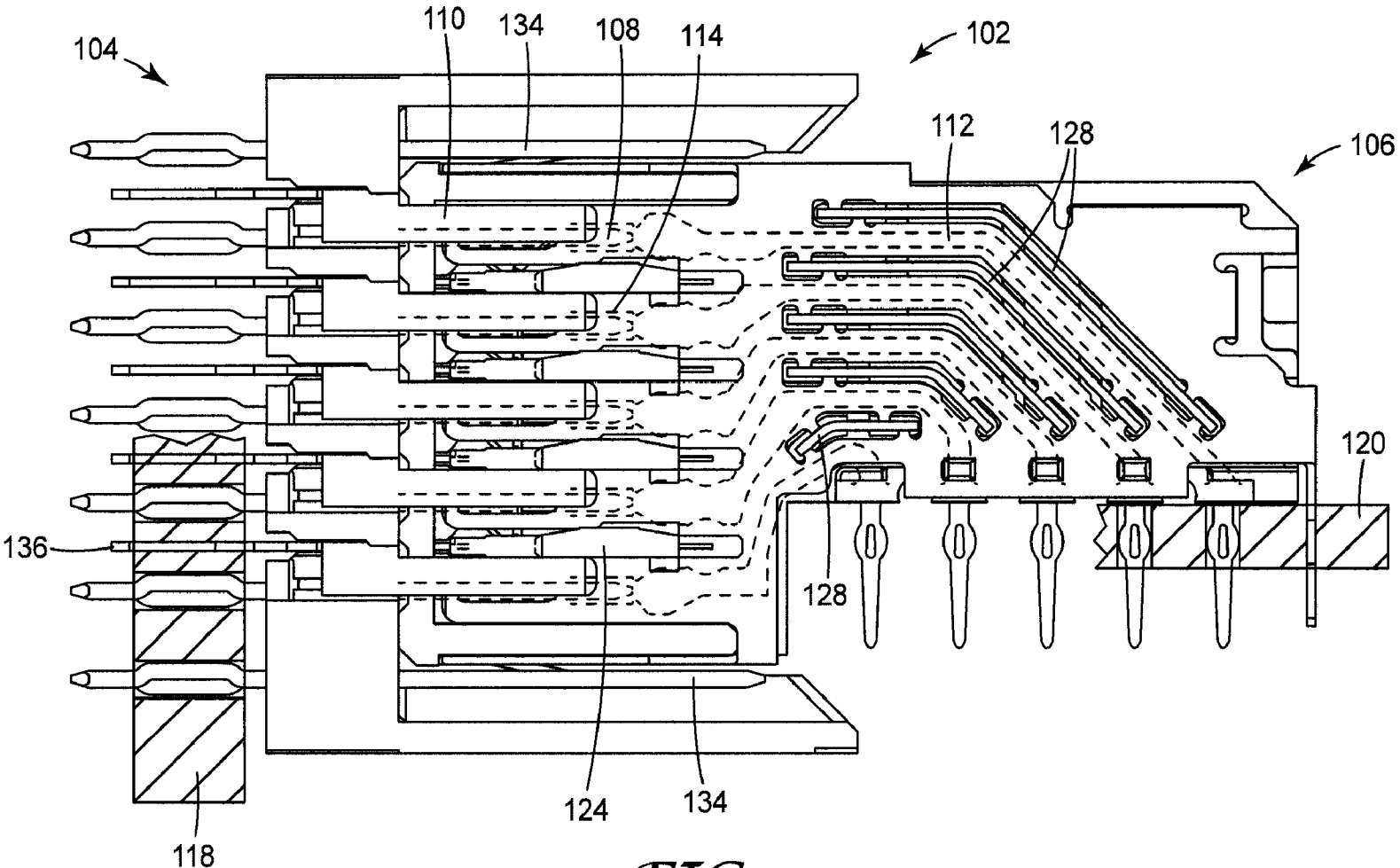
FIG. 3 is a partially cross-sectional side view of the electrical connector of FIG. 2.

FIGS. 1A-1E illustrate schematic representations of exemplary embodiments of an electrical connector according to various aspects of the present invention. Referring to FIG. 1A, electrical connector 2 includes a header connector 4 and a socket connector 6 configured to mate with header connector 4. Header connector 4 includes a plurality of signal pins 8 (only one signal pin 8 is shown), and a plurality of shield blades 10 (only one shield blade 10 is shown). Socket connector 6 includes a plurality of conductive paths 12 (only one conductive path 12 is shown), each conductive path 12 being coupled to a signal contact 14 (only one signal contact 14 is shown), and a plurality of first shields 16 (only one first shield 16 is shown). The plurality of signal pins 8 and the plurality of conductive paths 12 and signal contacts 14 are configured to form a plurality of transmission lines. The plurality of shield blades 10 and the plurality of first shields 16 are electrically connected (as illustrated by connection line A) and configured to provide interrupted shielding of the plurality of transmission lines when header connector 4 and socket connector 6 are in a mated configuration. Interrupted shielding of a transmission line is defined herein as shielding forming a discontinuous electrical path proximate to and associated with the transmission line and between two ground references, such as, e.g., the ground planes of two printed circuit boards. For example, the shielding may be electrically grounded on only one end. Examples of this are illustrated in FIGS. 1B-1E. In the exemplary embodiment illustrated in FIG. 1B, the plurality of shield blades 10 are electrically grounded. In this case, the shielding is interrupted at the end of socket connector 6, e.g., where the plurality of transmission lines would be connected to a printed circuit board or electrical cable (not shown). In the exemplary embodiment illustrated in FIG. 1C, the plurality of first shields 16 are electrically grounded. In this case, the shielding is interrupted at the end of header connector 4, e.g., where the plurality of transmission lines would be connected to a printed circuit board or electrical cable (not shown). In the exemplary embodiment illustrated in FIG. 1D, the plurality of first shields 16 are omitted from socket connector 6 and the plurality of shield blades 10 are electrically grounded. In this case, omitting the plurality of first shields 16 causes the shielding to be interrupted at the mating end of shield blades 10. In the exemplary embodiment illustrated in FIG. 1E, the plurality of shield blades 10 are omitted from header connector 4 and the plurality of first shields 16 are electrically grounded. In this case, omitting the plurality of shield blades 10 causes the shielding to be interrupted at the mating end of first shields 16.

Interrupted shielding of the plurality of transmission lines when header connector 4 and socket connector 6 are in a mated configuration may be provided by the plurality of shield blades 10 alone, or a portion thereof, by the plurality of first shields 16 alone, or a portion thereof, or by a combination of both, whereby the plurality of shield blades 10, or a portion thereof, and the plurality of first shields 16, or a portion thereof, are electrically connected. Both the plurality of shield blades 10, or a portion thereof, and the plurality of first shields 16, or a portion thereof, may contribute to providing interrupted shielding of the portion of the transmission line formed by the plurality of signal pins 8, the portion of the transmission line formed by the plurality of conductive paths 12 and signal contacts 14, or a combination of both.

Because of the interrupted shielding, one skilled in the art would expect the electrical performance of an electrical connector with interrupted shielding to be significantly lower than the electrical performance of the same electrical connector with uninterrupted shielding, e.g., when the shielding associated with the transmission line is electrically grounded on both ends, and specifically would expect larger discontinuities in the impedance profile of the electrical connector. However, as illustrated in the graph of FIG. 16B, the impedance profile of an electrical connector with interrupted shielding is unexpectedly similar to the impedance profile of the same electrical connector with uninterrupted shielding. The graph of FIG. 16B illustrates an example of the impedance profile of electrical connectors with interrupted shielding (line 908) and the impedance profile of the same electrical connectors with uninterrupted shielding (line 906). Both impedance profiles are measured using an assembly including two electrical connectors electrically connected via an electrical cable such that the signal travels through the first electrical connector (at location H), the electrical cable (at location I), and the second electrical connector (at location J), respectively. Both impedance profiles are measured at an input rise time of about 35 ps. corresponding to a rise time of about 100 ps. at the first connector entry.

In addition, because of the interrupted shielding, one skilled in the art would not expect the electrical performance of an electrical connector with interrupted shielding to be significantly higher than the electrical performance of the same electrical connector without shielding, and specifically would not expect smaller discontinuities in the impedance profile of the electrical connector. However, as illustrated in the graph of FIG. 16C, the discontinuities in the impedance profile of an electrical connector with interrupted shielding are unexpectedly smaller than the discontinuities in the impedance profile of the same electrical connector without shielding. The graph of FIG. 16C illustrates an example of the impedance profile of electrical connectors with interrupted shielding (line 908) and the impedance profile of the same electrical connectors without shielding (line 902). Both impedance profiles are measured using an assembly including two electrical connectors electrically connected via an electrical cable such that the signal travels through the first electrical connector (at location H), the electrical cable (at location I), and the second electrical connector (at location J), respectively. Both impedance profiles are measured at an input rise time of about 35 ps. corresponding to a rise time of about 100 ps. at the first connector entry.

Examples of electrical connectors without shielding include hard metric connectors according to industry standard IEC 61076-4-101 and hard metric connectors according to the CompactPCI or FutureBus industry standards. Examples of electrical connectors with uninterrupted shielding are shown and described in U.S. Pat. Nos. 6,146,202, 6,231,391, and 6,371,813.

FIGS. 2-15 illustrate various exemplary embodiments of an electrical connector with interrupted shielding according to aspects of the present invention including a socket connector and a header connector.

Referring to FIGS. 2-5, electrical connector 102 includes a header connector 104 and a socket connector 106 configured to mate with header connector 104. Header connector 104 is configured to be coupled to a first printed circuit board 118 and includes a plurality of signal pins 108 and a plurality of shield blades 110. Socket connector 106 is configured to be coupled to a second printed circuit board 120 and includes a plurality of conductive paths 112, each conductive path 112 being coupled to a signal contact 114, and a plurality of first shields 116. The plurality of signal pins 108 and the plurality of conductive paths 112 and signal contacts 114 are configured to form a plurality of transmission lines. The plurality of shield blades 110 and the plurality of first shields 116 are electrically connected and configured to provide interrupted shielding of the plurality of transmission lines when header connector 104 and socket connector 106 are in a mated configuration.

Figure 4:
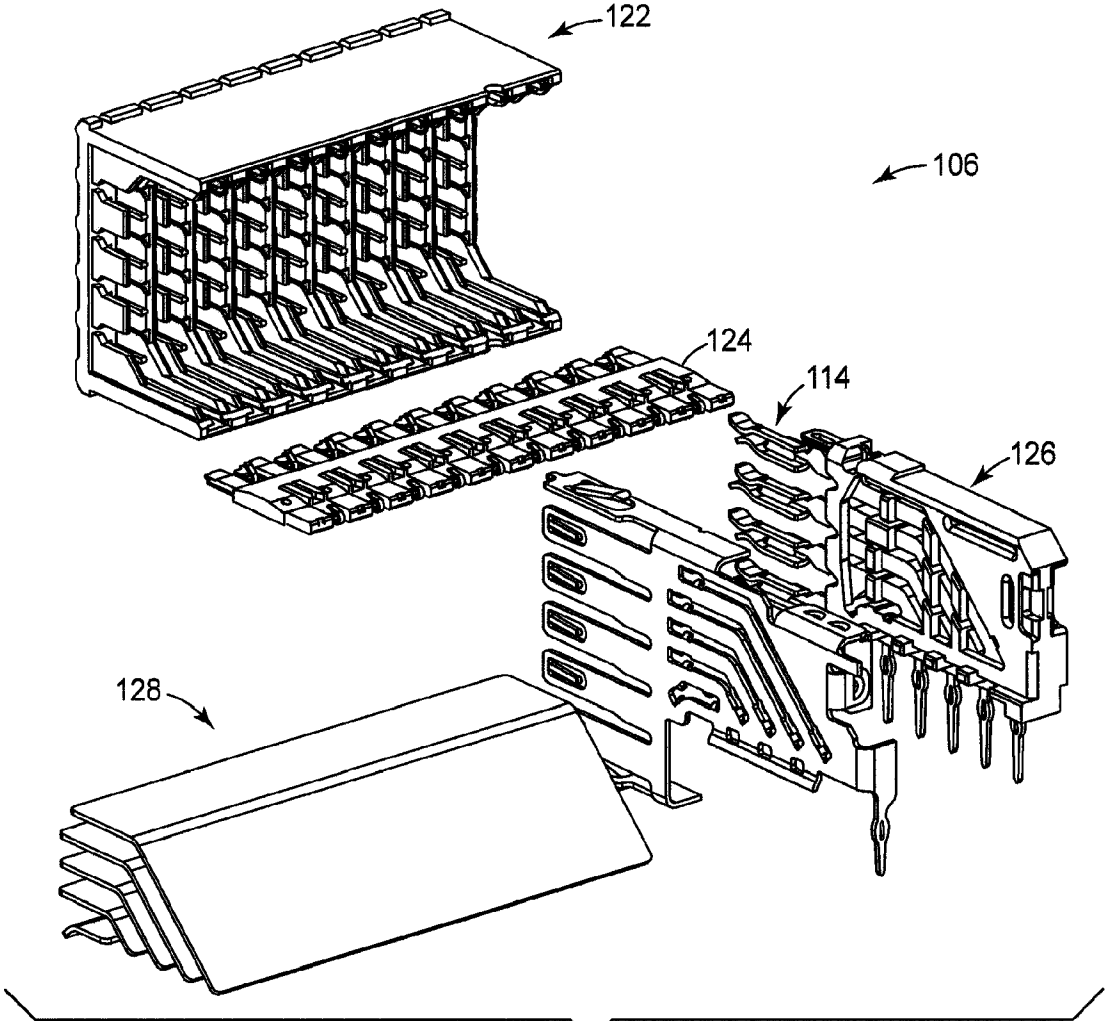
FIG. 4 is an exploded perspective view of the socket connector of FIG. 2.

FIG. 4 illustrates an exploded perspective view of socket connector 106. Socket connector 106 includes a socket housing 122, a plurality of horizontal shields 124 (also referenced to herein as "third shields"), a plurality of connector modules 126 (also known as "wafers"), a plurality of vertical stripline shields 116 (also referenced herein as "first shields" or "first shield portions"), and a plurality of laterally extending angled tail shields 128 (also referenced herein as "second shields" or "second shield portions"). For the sake of clarity, only one each of the plurality of third shields 124, the plurality of connector modules 126, and the plurality of first shields 116 are shown in FIG. 4. Examples of socket connectors similar to socket connector 106 are shown and described in U.S. Pat. Nos. 6,146,202, 6,231,391, and 6,371,813, each of which is incorporated by reference herein in its entirety. Unlike these examples of socket connectors, the plurality of first shields 116 of socket connector 106 do not include a plurality of side shield tails (such as, e.g., side shield tails 300 in U.S. Pat. No. 6,146,202). The absence of a plurality of side shield tails interrupts the shielding of the transmission lines of electrical connector 102 where the plurality of transmission lines are configured to be connected to second printed circuit board 120. In one embodiment, the absence of a plurality of side shield tails enables the omission of corresponding holes 130 in second printed circuit board 120, which enables the use of printed circuit board hole patterns for hard metric connectors according to industry standard IEC 61076-4-101 and hard metric connectors according to the CompactPCI or FutureBus industry standards.

Figure 5:
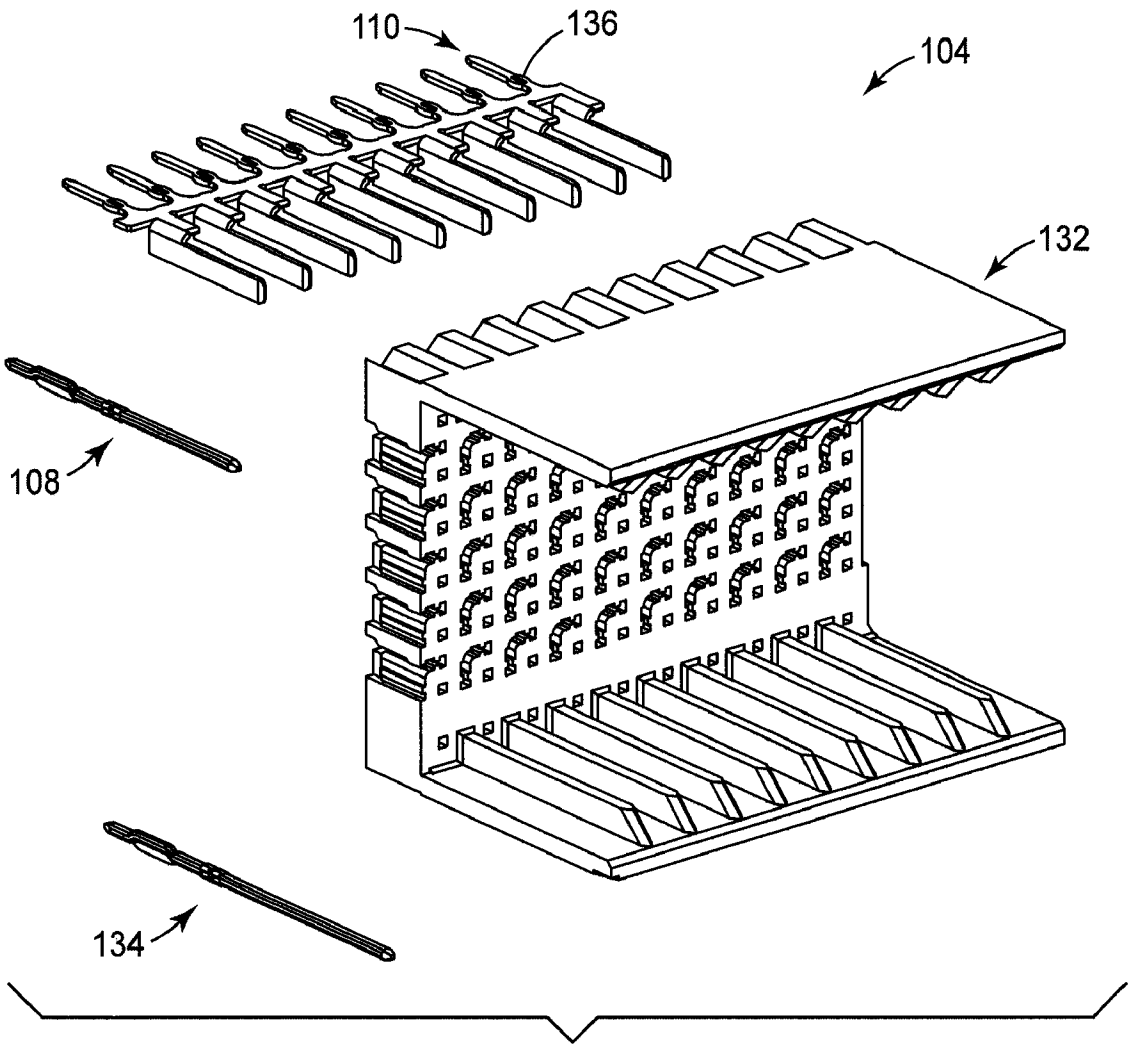
FIG. 5 is an exploded perspective view of the header connector of FIG. 2.

FIG. 5 illustrates an exploded perspective view of header connector 104. Header connector 104 includes a header body 132, a plurality of signal pins 108, a continuous strip having a plurality of shield blades 110 formed therein, and a plurality of ground pins 134. Examples of header connectors similar to header connector 104 that can be used in electrical connector 102 are shown and described in U.S. Pat. Nos. 6,146,202, 6,231,391, and 6,371,813.

To facilitate interrupted shielding of the plurality of transmission lines in electrical connector 102, the plurality of shield blades 110 are configured to be electrically grounded. Electrical grounding of the plurality of shield blades 110 occurs through a plurality of shield tails 136 that can be press-fitted and/or soldered to holes 138 of first printed circuit board 118. Alternatively, electrical grounding of the plurality of shield blades 110 to first printed circuit board 118 may be achieved using any suitable method/structure, including but not limited to press-fit, soldering, surface mount, friction fit, mechanical clamping, and adhesive.

Figure 6:
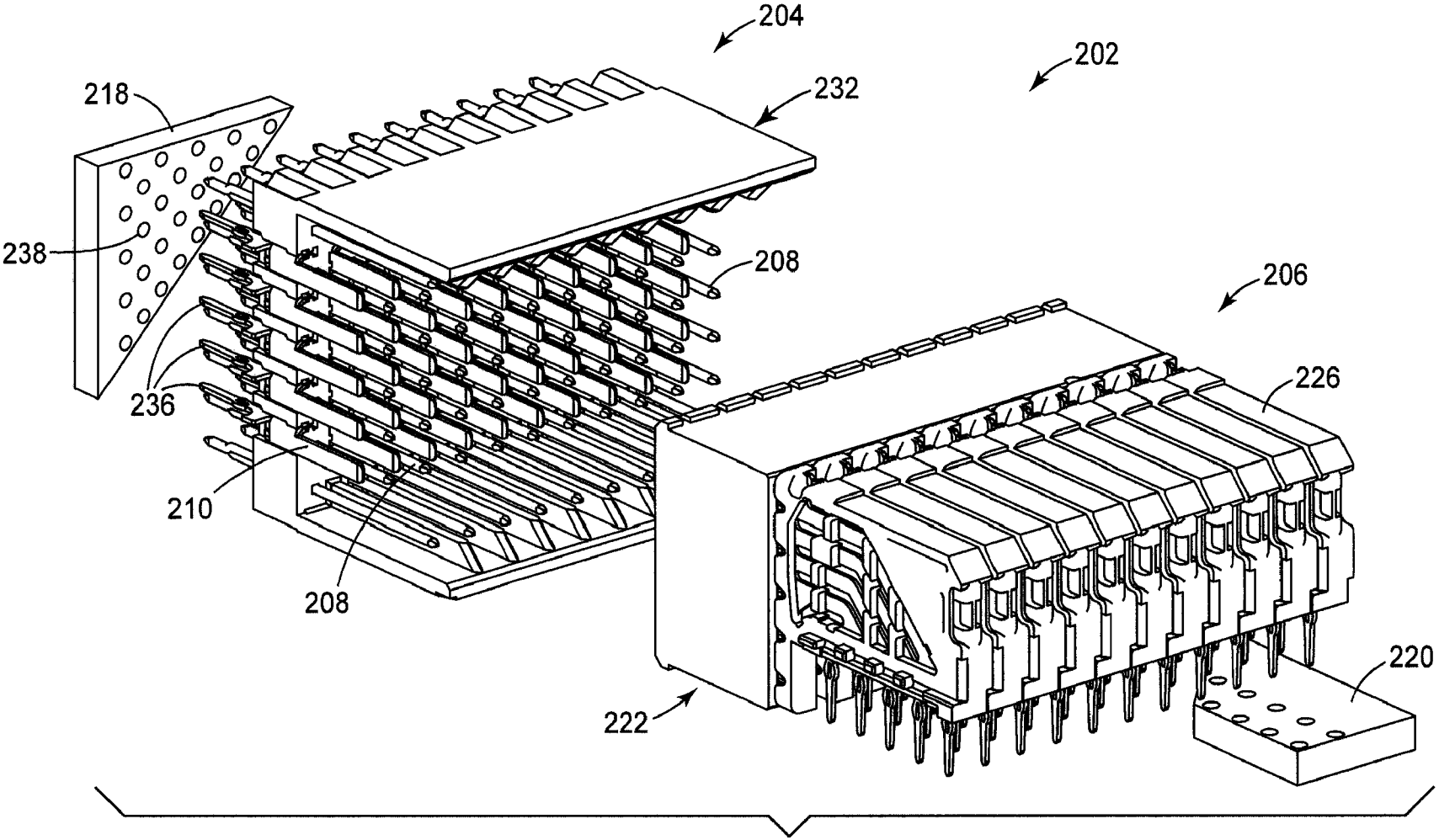
FIG. 6 is a perspective exploded view of another exemplary embodiment of an electrical connector according to an aspect of the present invention.
Figure 7:
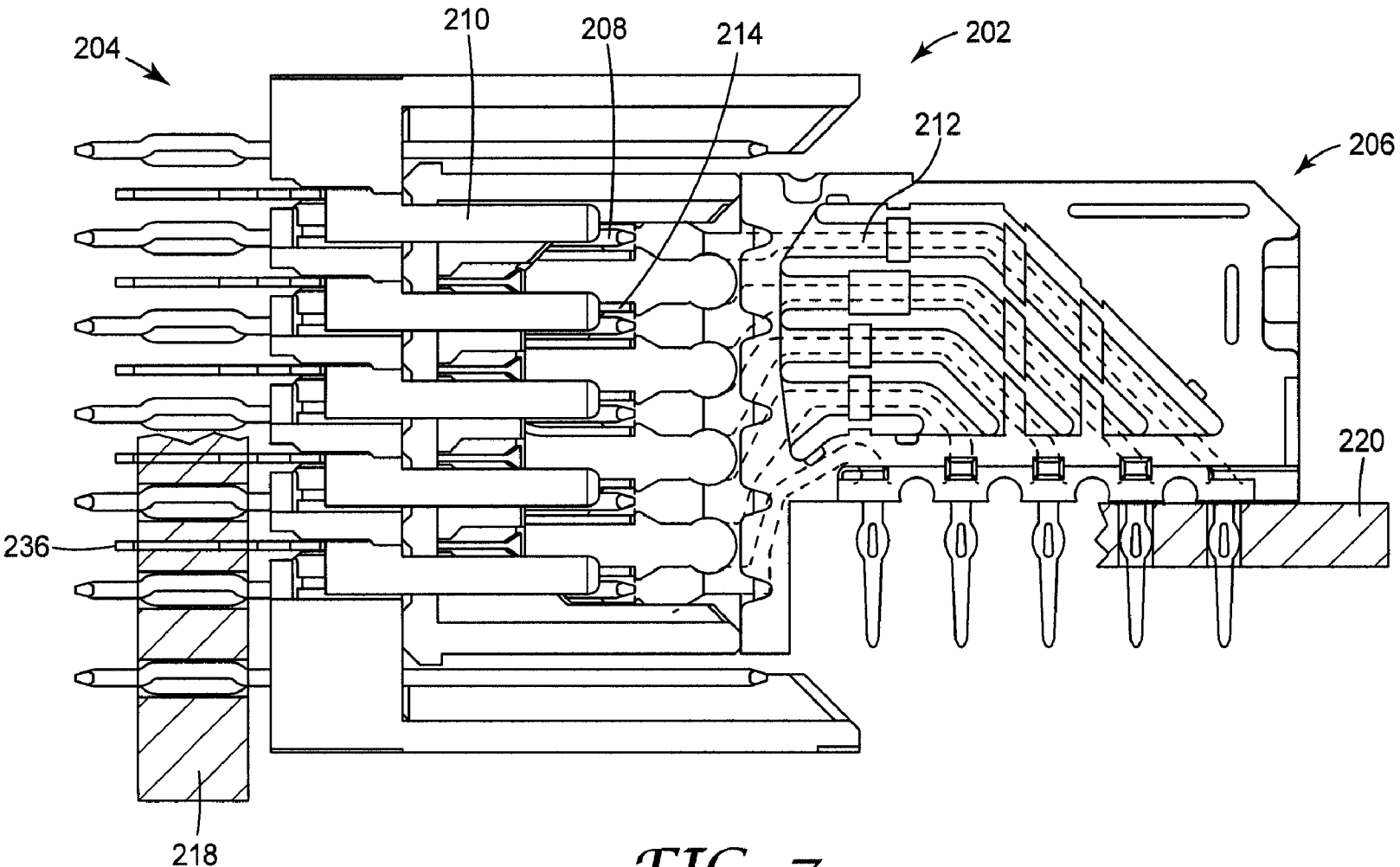
FIG. 7 is a partially cross-sectional side view of the electrical connector of FIG. 6.

Referring to FIGS. 6 and 7, electrical connector 202 includes a header connector 204 and a socket connector 206 configured to mate with header connector 204. Header connector 204 is configured to be coupled to a first printed circuit board 218 and includes a plurality of signal pins 208 and a plurality of shield blades 210. Socket connector 206 is configured to be coupled to a second printed circuit board 220 and includes a plurality of conductive paths 212, each conductive path 212 being coupled to a signal contact 214. The plurality of signal pins 208 and the plurality of conductive paths 212 and signal contacts 214 are configured to form a plurality of transmission lines. The plurality of shield blades 210 are configured to provide interrupted shielding of the plurality of transmission lines when header connector 204 and socket connector 206 are in a mated configuration.

Socket connector 206 includes a socket housing 222 and a plurality of connector modules 226 (also known as "wafers"). Socket connector 206 may be a hard metric socket connector according to industry standard IEC 61076-4-101 or a hard metric socket connector according to the CompactPCI or FutureBus industry standards. In one aspect, socket connector 206 is similar to socket connector 106 (shown in FIGS. 2-4). However, unlike socket connector 106, socket connector 206 does not include a plurality of first shields (such as, e.g., first shields 116), a plurality of second shields (such as, e.g., second shields 128), or a plurality of third shields (such as, e.g., third shields 124). The absence of a plurality of first shields, a plurality of second shields, and a plurality of third shields interrupts the shielding of the transmission lines of electrical connector 202 at the mating end of shield blades 210. In one embodiment, socket connector 206 can be mounted to second printed circuit board 220 using a printed circuit board hole pattern for hard metric connectors according to industry standard IEC 61076-4-101 or hard metric connectors according to the CompactPCI or FutureBus industry standards.

Header connector 204 includes a header body 232, a plurality of signal pins 208, and a continuous strip having a plurality of shield blades 210 formed therein. Examples of header connectors similar to header connector 204 that can be used in electrical connector 202 are shown and described in U.S. Pat. Nos. 6,146,202, 6,231,391, and 6,371,813. In one aspect, header connector 204 is similar to header connector 104 (shown in FIGS. 2, 3, and 5). However, unlike header connector 104, header connector 204 does not include a plurality of ground pins (such as, e.g., ground pins 134).

To facilitate interrupted shielding of the plurality of transmission lines in electrical connector 202, the plurality of shield blades 210 are configured to be electrically grounded. Electrical grounding of the plurality of shield blades 210 occurs through a plurality of shield tails 236 that can be press-fitted and/or soldered to holes 238 of first printed circuit board 218. Alternatively, electrical grounding of the plurality of shield blades 210 to first printed circuit board 218 may be achieved using any suitable method/structure, including but not limited to press-fit, soldering, surface mount, friction fit, mechanical clamping, and adhesive.

Figure 8:
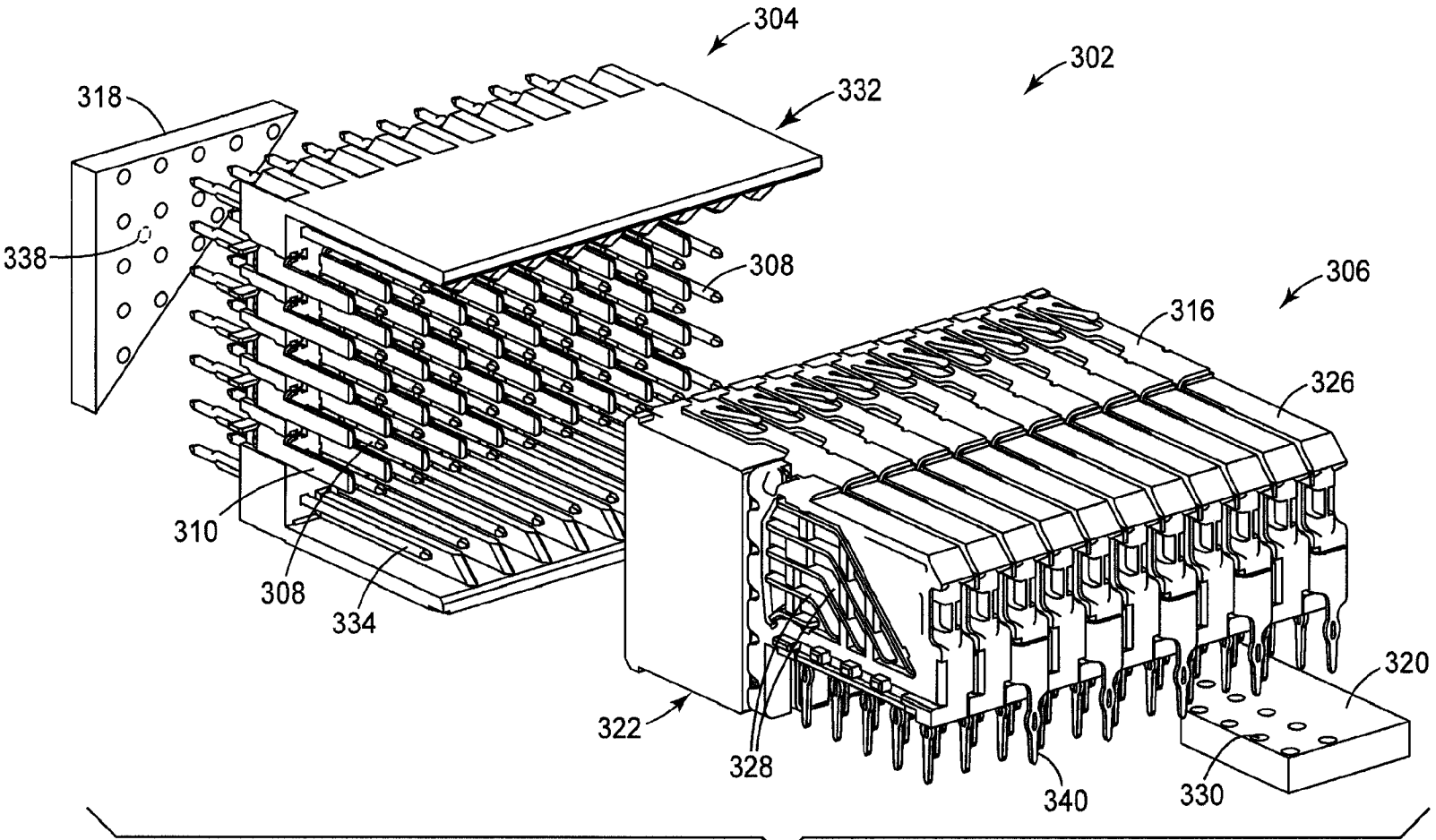
FIG. 8 is a perspective exploded view of another exemplary embodiment of an electrical connector according to an aspect of the present invention.
Figure 9:
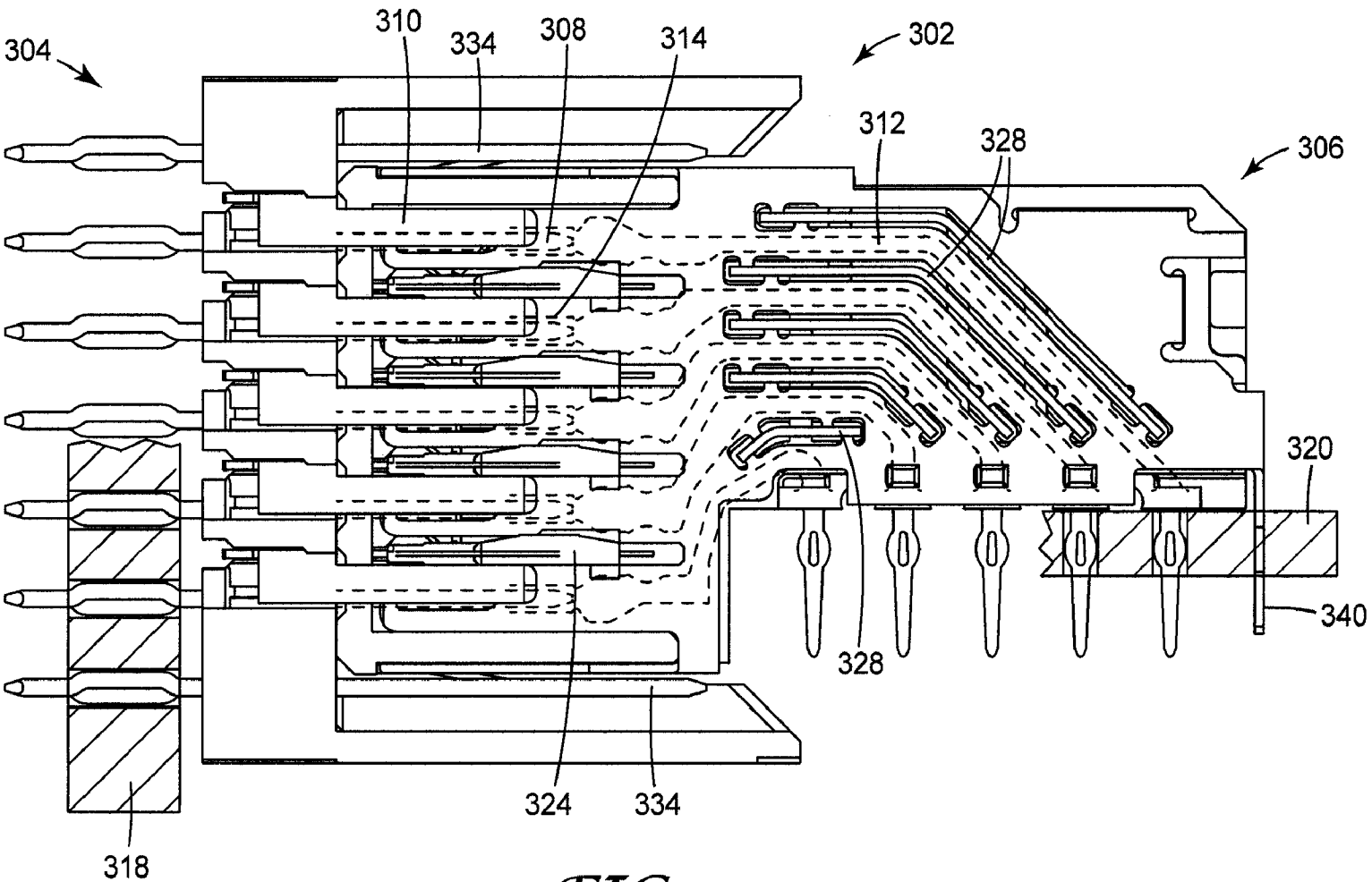
FIG. 9 is a partially cross-sectional side view of the electrical connector of FIG. 8.

Referring to FIGS. 8 and 9, electrical connector 302 includes a header connector 304 and a socket connector 306 configured to mate with header connector 304. Header connector 304 is configured to be coupled to a first printed circuit board 318 and includes a plurality of signal pins 308 and a plurality of shield blades 310. Socket connector 306 is configured to be coupled to a second printed circuit board 320 and includes a plurality of conductive paths 312, each conductive path 312 being coupled to a signal contact 314, and a plurality of first shields 316. The plurality of signal pins 308 and the plurality of conductive paths 312 and signal contacts 314 are configured to form a plurality of transmission lines. The plurality of shield blades 310 and the plurality of first shields 316 are electrically connected and configured to provide interrupted shielding of the plurality of transmission lines when header connector 304 and socket connector 306 are in a mated configuration.

Socket connector 306 includes a socket housing 322, a plurality of horizontal shields 324 (also referenced to herein as "third shields"), a plurality of connector modules 326 (also known as "wafers"), a plurality of vertical stripline shields 316 (also referenced herein as "first shields" or "first shield portions"), and a plurality of laterally extending angled tail shields 328 (also referenced herein as "second shields" or "second shield portions"). Examples of socket connectors similar to socket connector 306 are shown and described in U.S. Pat. Nos. 6,146,202, 6,231,391, and 6,371,813. Unlike these examples of socket connectors, the plurality of first shields 316 of socket connector 306 do not include a plurality of side shield tails (such as, e.g., side shield tails 300 in U.S. Pat. No. 6,146,202). In one embodiment, the absence of a plurality of side shield tails enables the omission of corresponding holes 330 in second printed circuit board 320, which enables the use of printed circuit board hole patterns for hard metric connectors according to industry standard IEC 61076-4-101 and hard metric connectors according to the CompactPCI or FutureBus industry standards.

Header connector 304 includes a header body 332, a plurality of signal pins 308, a continuous strip having a plurality of shield blades 310 formed therein, and a plurality of ground pins 334. Examples of header connectors similar to header connector 304 are shown and described in U.S. Pat. Nos. 6,146,202, 6,231,391, and 6,371,813. In one aspect, header connector 304 is similar to header connector 104 (shown in FIGS. 2, 3, and 5). However, unlike the plurality of shield blades 110 of header connector 104, the plurality of shield blades 310 of header connector 304 do not include a plurality of shield tails (such as, e.g., shield tails 136). The absence of a plurality of shield tails interrupts the shielding of the transmission lines of electrical connector 302 where the plurality of transmission lines are configured to be connected to first printed circuit board 318. In one embodiment, the absence of a plurality of shield tails enables the omission of corresponding holes 338 in first printed circuit board 318, which enables the use of printed circuit board hole patterns for hard metric connectors according to industry standard IEC 61076-4-101 and hard metric connectors according to the CompactPCI or FutureBus industry standards.

To facilitate interrupted shielding of the plurality of transmission lines in electrical connector 302, the plurality of first shields 316 of socket connector 306 are configured to be electrically grounded. Every other one of the plurality of first shields 316 includes an end shield tail 340 configured to provide the electrical grounding of the plurality of first shields 316. End shield tails 340 can be press-fitted and/or soldered to holes 330 of second printed circuit board 320. Alternatively, electrical grounding of the plurality of first shields 316 to second printed circuit board 320 may be achieved using any suitable method/structure, including but not limited to press-fit, soldering, surface mount, friction fit, mechanical clamping, and adhesive.

Figure 10:
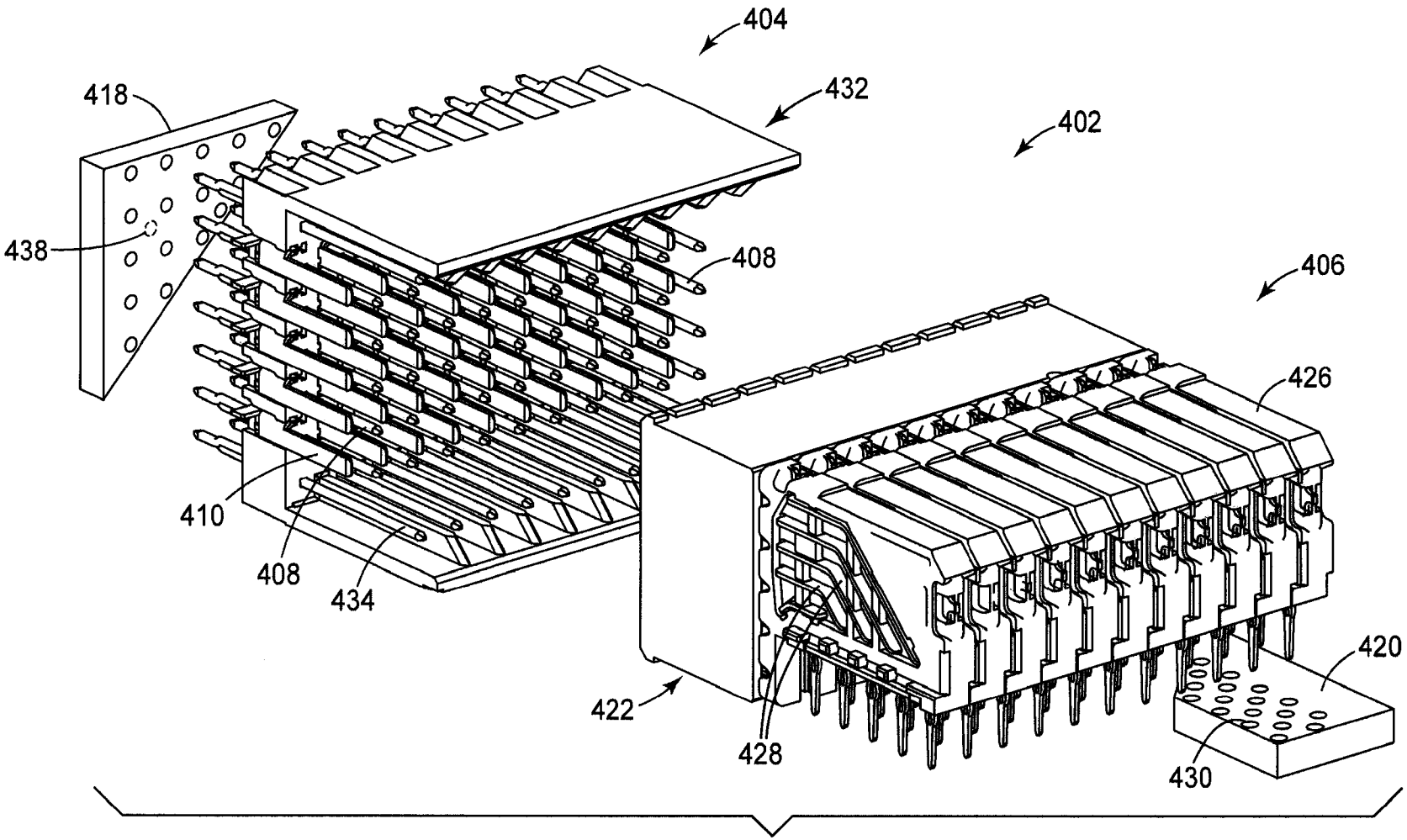
FIG. 10 is a perspective exploded view of another exemplary embodiment of an electrical connector according to an aspect of the present invention.
Figure 11:
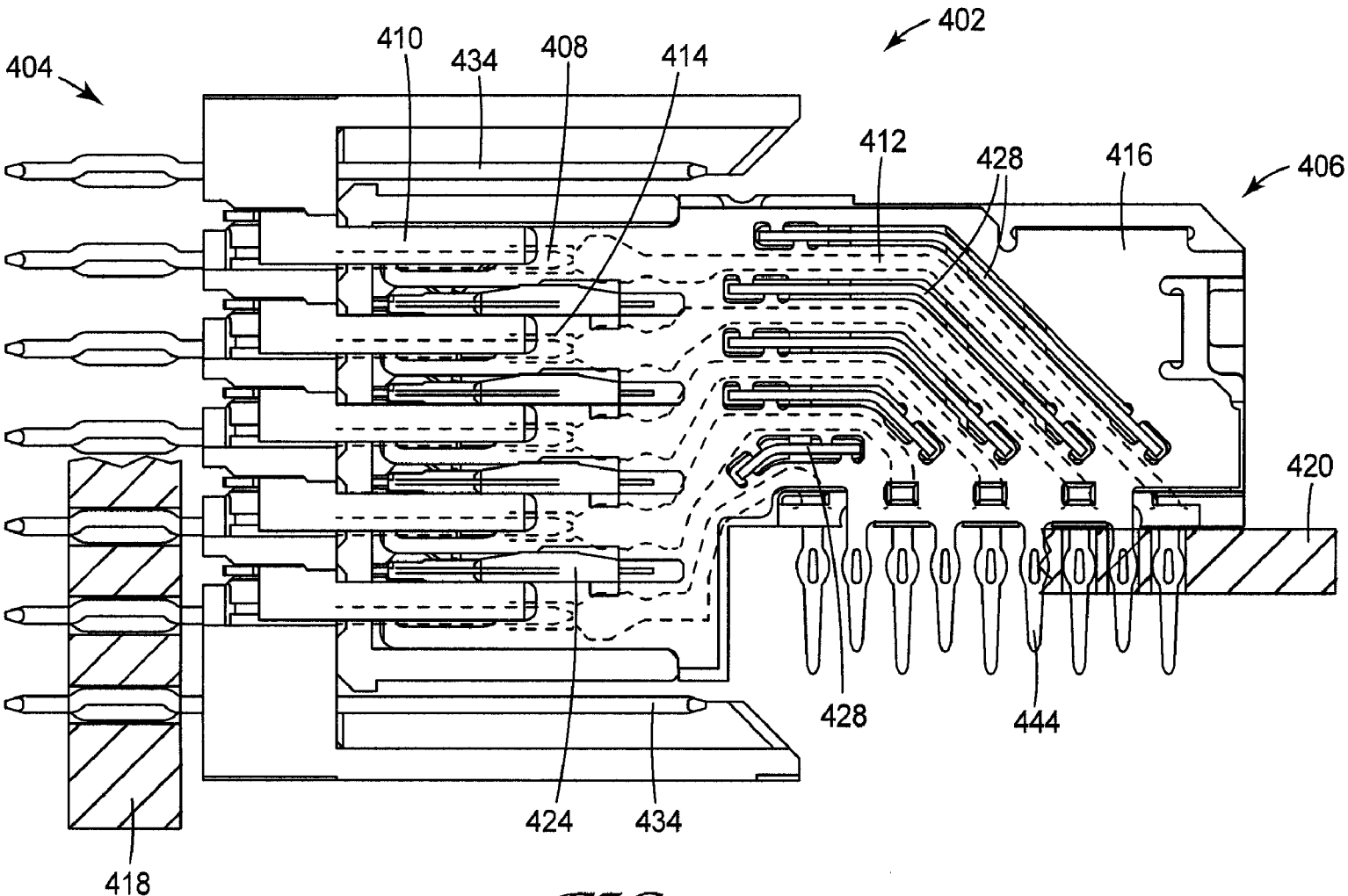
FIG. 11 is a partially cross-sectional side view of the electrical connector of FIG. 10.

Referring to FIGS. 10 and 11, electrical connector 402 includes a header connector 404 and a socket connector 406 configured to mate with header connector 404. Header connector 404 is configured to be coupled to a first printed circuit board 418 and includes a plurality of signal pins 408 and a plurality of shield blades 410. Socket connector 406 is configured to be coupled to a second printed circuit board 420 and includes a plurality of conductive paths 412, each conductive path 412 being coupled to a signal contact 414, and a plurality of first shields 416. The plurality of signal pins 408 and the plurality of conductive paths 412 and signal contacts 414 are configured to form a plurality of transmission lines. The plurality of shield blades 410 and the plurality of first shields 416 are electrically connected and configured to provide interrupted shielding of the plurality of transmission lines when header connector 404 and socket connector 406 are in a mated configuration.

Socket connector 406 includes a socket housing 422, a plurality of horizontal shields 424 (also referenced to herein as "third shields"), a plurality of connector modules 426 (also known as "wafers"), a plurality of vertical stripline shields 416 (also referenced herein as "first shields" or "first shield portions"), and a plurality of laterally extending angled tail shields 428 (also referenced herein as "second shields" or "second shield portions"). Examples of socket connectors similar to socket connector 406 that can be used in electrical connector 402 are shown and described in U.S. Pat. Nos. 6,146,202, 6,231,391, and 6,371,813.

Header connector 404 includes a header body 432, a plurality of signal pins 408, a continuous strip having a plurality of shield blades 410 formed therein, and a plurality of ground pins 434. Examples of header connectors similar to header connector 404 are shown and described in U.S. Pat. Nos. 6,146,202, 6,231,391, and 6,371,813. In one aspect, header connector 404 is similar to header connector 104 (shown in FIGS. 2, 3, and 5). However, unlike the plurality of shield blades 110 of header connector 104, the plurality of shield blades 410 of header connector 404 do not include a plurality of shield tails (such as, e.g., shield tails 136). The absence of a plurality of shield tails interrupts the shielding of the transmission lines of electrical connector 402 where the plurality of transmission lines are configured to be connected to first printed circuit board 418. In one embodiment, the absence of a plurality of shield tails enables the omission of corresponding holes 438 in first printed circuit board 418, which enables the use of printed circuit board hole patterns for hard metric connectors according to industry standard IEC 61076-4-101 and hard metric connectors according to the CompactPCI or FutureBus industry standards.

To facilitate interrupted shielding of the plurality of transmission lines in electrical connector 402, the plurality of first shields 416 of socket connector 406 are configured to be electrically grounded. Each of the plurality of first shields 416 includes a plurality of shield tails, in one embodiment arranged as a plurality of side shield tails 444, configured to provide the electrical grounding of the plurality of first shields 416. Side shield tails 444 can be press-fitted and/or soldered to holes 430 of second printed circuit board 420. Alternatively, electrical grounding of the plurality of first shields 416 to second printed circuit board 420 may be achieved using any suitable method/structure, including but not limited to press-fit, soldering, surface mount, friction fit, mechanical clamping, and adhesive.

Figure 12:
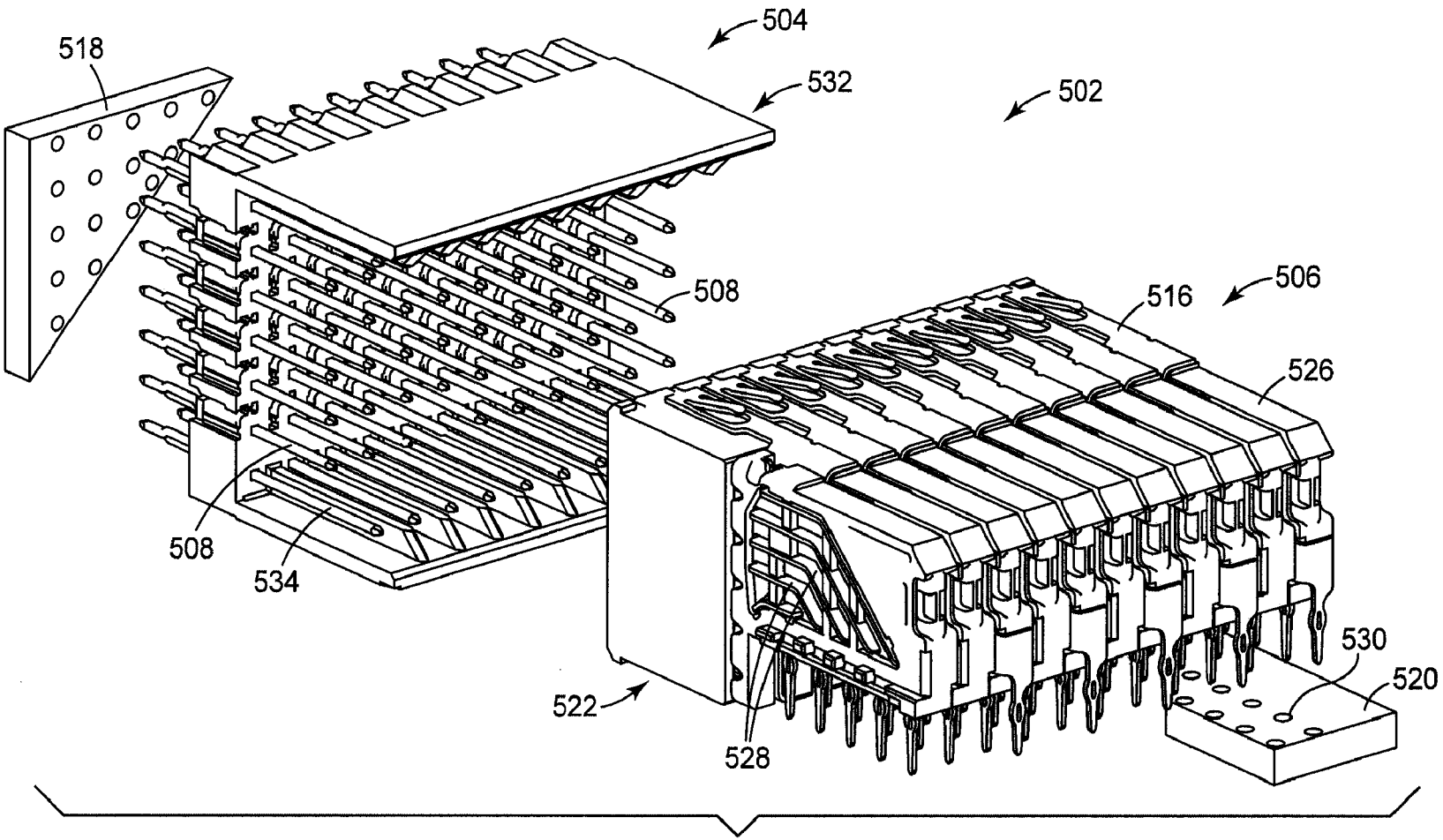
FIG. 12 is a perspective exploded view of another exemplary embodiment of an electrical connector according to an aspect of the present invention.
Figure 13:
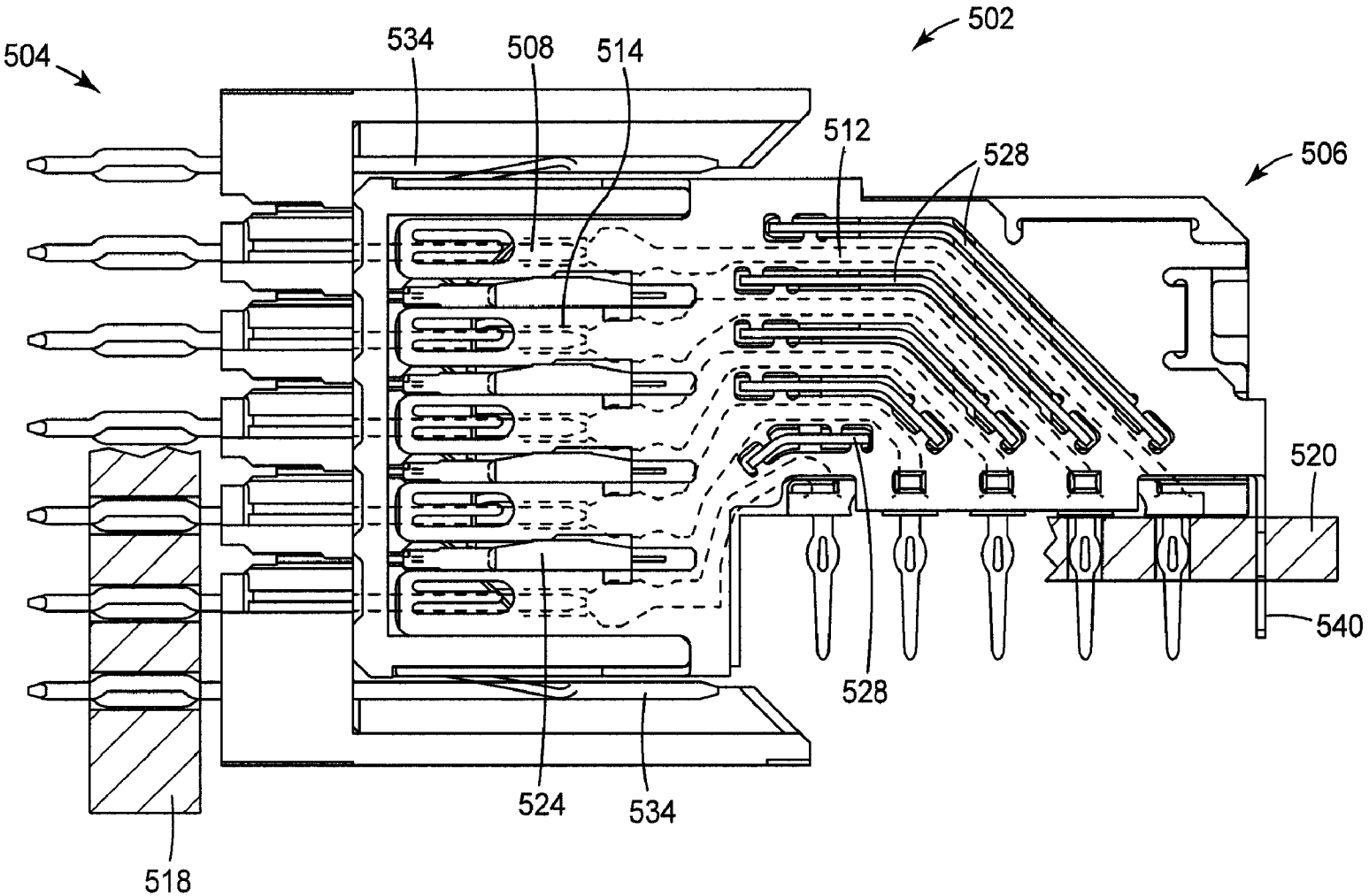
FIG. 13 is a partially cross-sectional side view of the electrical connector of FIG. 12.

Referring to FIGS. 12 and 13, electrical connector 502 includes a header connector 504 and a socket connector 506 configured to mate with header connector 504. Header connector 504 is configured to be coupled to a first printed circuit board 518 and includes a plurality of signal pins 508. Socket connector 506 is configured to be coupled to a second printed circuit board 520 and includes a plurality of conductive paths 512, each conductive path 512 being coupled to a signal contact 514, and a plurality of first shields 516. The plurality of signal pins 508 and the plurality of conductive paths 512 and signal contacts 514 are configured to form a plurality of transmission lines. The plurality of first shields 516 are configured to provide interrupted shielding of the plurality of transmission lines when header connector 504 and socket connector 506 are in a mated configuration.

Socket connector 506 includes a socket housing 522, a plurality of horizontal shields 524 (also referenced to herein as "third shields"), a plurality of connector modules 526 (also known as "wafers"), a plurality of vertical stripline shields 516 (also referenced herein as "first shields" or "first shield portions"), and a plurality of laterally extending angled tail shields 528 (also referenced herein as "second shields" or "second shield portions"). Examples of socket connectors similar to socket connector 506 are shown and described in U.S. Pat. Nos. 6,146,202, 6,231,391, and 6,371,813. Unlike these examples of socket connectors, the plurality of first shields 516 of socket connector 506 do not include a plurality of side shield tails (such as, e.g., side shield tails 300 in U.S. Pat. No. 6,146,202). In one embodiment, the absence of a plurality of side shield tails enables the omission of corresponding holes 530 in second printed circuit board 520, which enables the use of printed circuit board hole patterns for hard metric connectors according to industry standard IEC 61076-4-101 and hard metric connectors according to the CompactPCI or FutureBus industry standards.

Header connector 504 includes a header body 532, a plurality of signal pins 508, and a plurality of ground pins 534. Header connector 504 may be a hard metric header connector according to industry standard IEC 61076-4-101 or a hard metric header connector according to the CompactPCI or FutureBus industry standards. In one aspect, header connector 504 is similar to header connector 104 (shown in FIGS. 2, 3, and 5). However, unlike header connector 104, header connector 504 does not include a plurality of shield blades (such as, e.g., shield blades 110). The absence of a plurality of shield blades interrupts the shielding of the transmission lines of electrical connector 502 at the mating end of first shields 516. In one embodiment, header connector 504 can be mounted to first printed circuit board 518 using a printed circuit board hole pattern for hard metric connectors according to industry standard IEC 61076-4-101 or hard metric connectors according to the CompactPCI or FutureBus industry standards.

To facilitate interrupted shielding of the plurality of transmission lines in electrical connector 502, the plurality of first shields 516 of socket connector 506 are configured to be electrically grounded. Every other one of the plurality of first shields 516 includes an end shield tail 540 configured to provide the electrical grounding of the plurality of first shields 516. End shield tails 540 can be press-fitted and/or soldered to holes 530 of second printed circuit board 520. Alternatively, electrical grounding of the plurality of first shields 516 to second printed circuit board 520 may be achieved using any suitable method/structure, including but not limited to press-fit, soldering, surface mount, friction fit, mechanical clamping, and adhesive.

Figure 14:
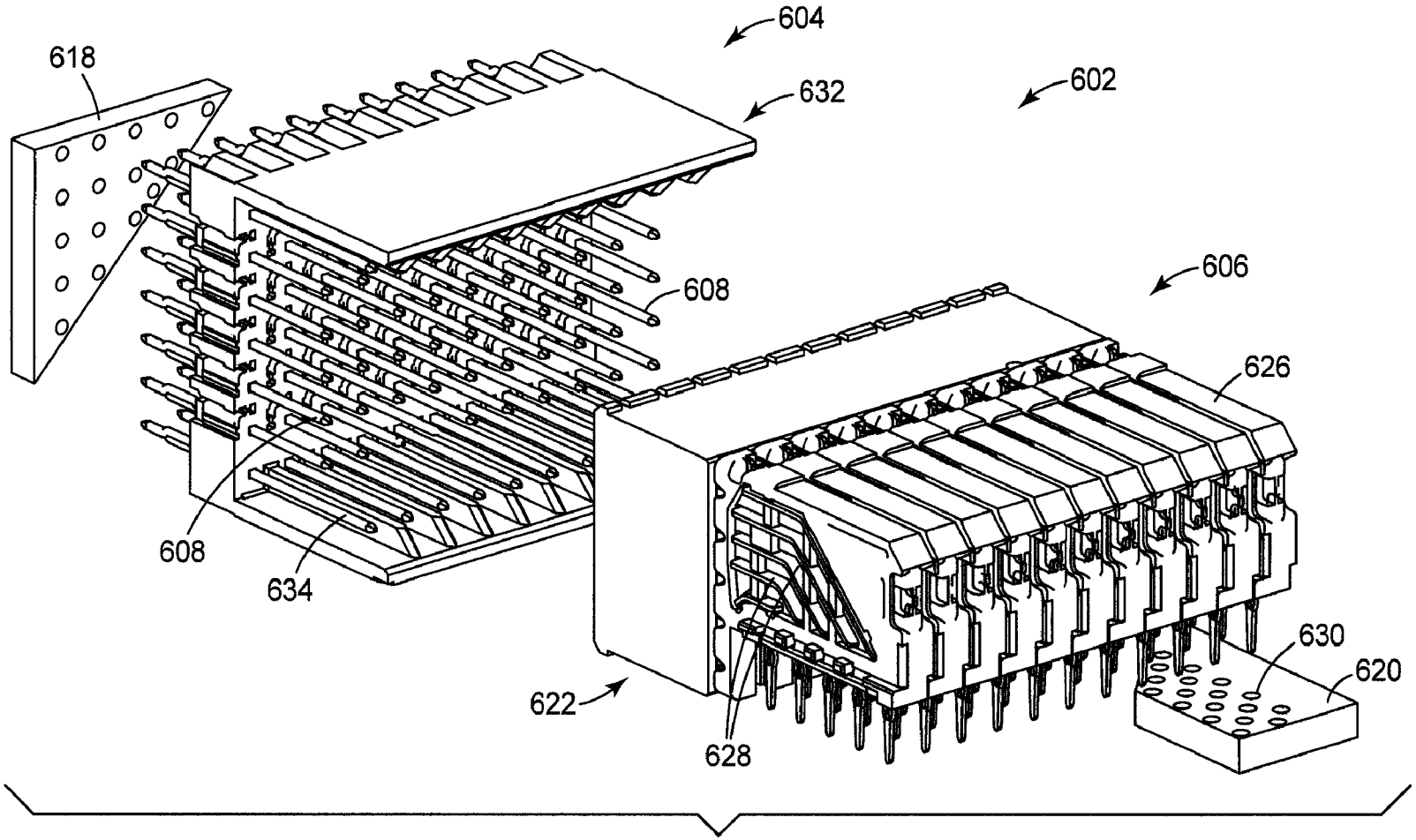
FIG. 14 is a perspective exploded view of another exemplary embodiment of an electrical connector according to an aspect of the present invention.
Figure 15:
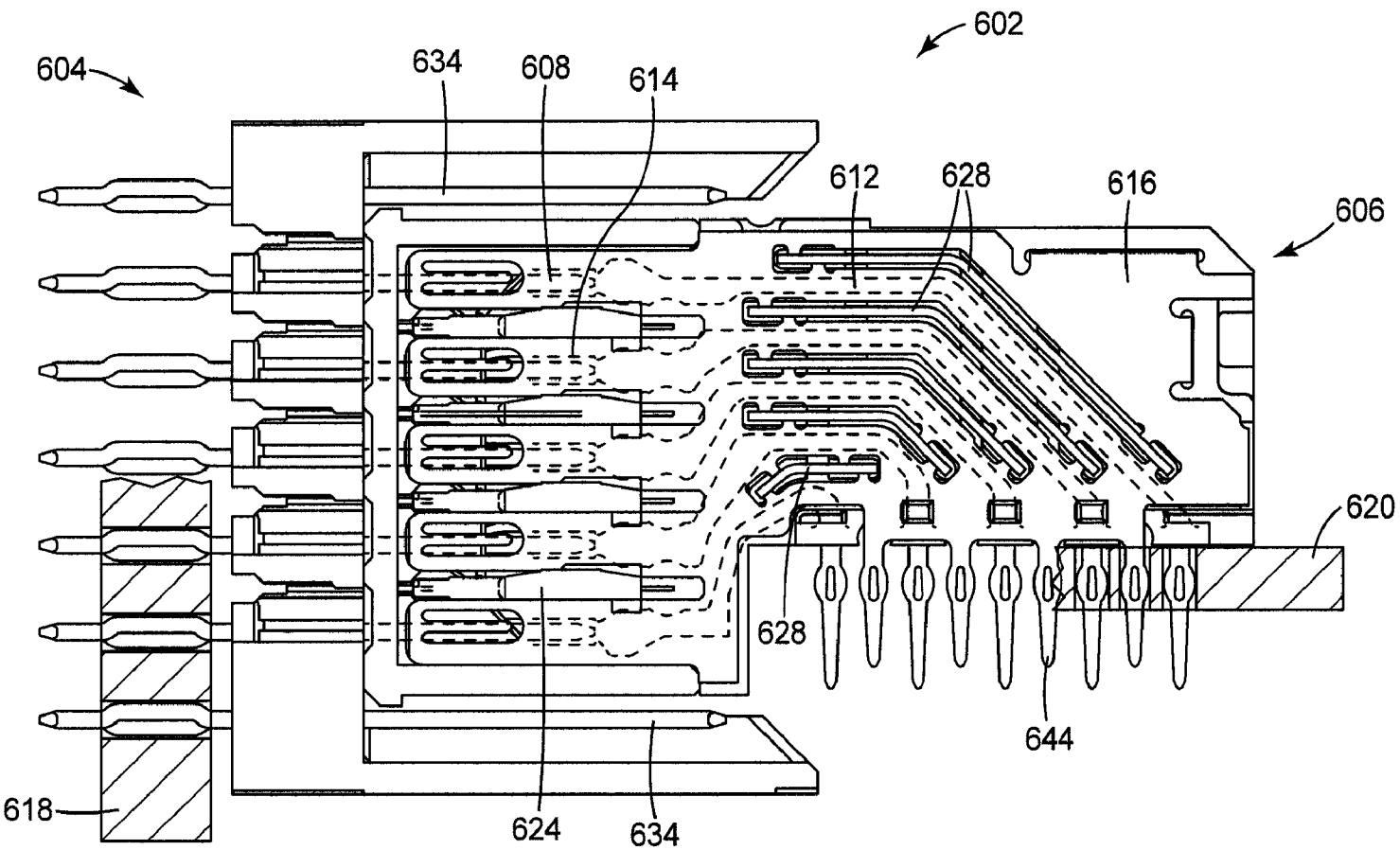
FIG. 15 is a partially cross-sectional side view of the electrical connector of FIG. 14.

Referring to FIGS. 14 and 15, electrical connector 602 includes a header connector 604 and a socket connector 606 configured to mate with header connector 604. Header connector 604 is configured to be coupled to a first printed circuit board 618 and includes a plurality of signal pins 608. Socket connector 606 is configured to be coupled to a second printed circuit board 620 and includes a plurality of conductive paths 612, each conductive path 612 being coupled to a signal contact 614, and a plurality of first shields 616. The plurality of signal pins 608 and the plurality of conductive paths 612 and signal contacts 614 are configured to form a plurality of transmission lines. The plurality of first shields 616 are configured to provide interrupted shielding of the plurality of transmission lines when header connector 604 and socket connector 606 are in a mated configuration.

Socket connector 606 includes a socket housing 622, a plurality of horizontal shields 624 (also referenced to herein as "third shields"), a plurality of connector modules 626 (also known as "wafers"), a plurality of vertical stripline shields 616 (also referenced herein as "first shields" or "first shield portions"), and a plurality of laterally extending angled tail shields 628 (also referenced herein as "second shields" or "second shield portions"). Examples of socket connectors similar to socket connector 606 that can be used in electrical connector 602 are shown and described in U.S. Pat. Nos. 6,146,202, 6,231,391, and 6,371,813.

Header connector 604 includes a header body 632, a plurality of signal pins 608, and a plurality of ground pins 634. Header connector 604 may be a hard metric header connector according to industry standard IEC 61076-4-101 or a hard metric header connector according to the CompactPCI or FutureBus industry standards. In one aspect, header connector 604 is similar to header connector 104 (shown in FIGS. 2, 3, and 5). However, unlike header connector 104, header connector 604 does not include a plurality of shield blades (such as, e.g., shield blades 110). The absence of a plurality of shield blades interrupts the shielding of the transmission lines of electrical connector 602 at the mating end of first shields 616. In one embodiment, header connector 604 can be mounted to first printed circuit board 618 using a printed circuit board hole pattern for hard metric connectors according to industry standard IEC 61076-4-101 or hard metric connectors according to the CompactPCI or FutureBus industry standards.

To facilitate interrupted shielding of the plurality of transmission lines in electrical connector 602, the plurality of first shields 616 of socket connector 606 are configured to be electrically grounded. Each of the plurality of first shields 616 includes a plurality of shield tails, in one embodiment arranged as a plurality of side shield tails 644, configured to provide the electrical grounding of the plurality of first shields 616. Side shield tails 644 can be press-fitted and/or soldered to holes 630 of second printed circuit board 620. Alternatively, electrical grounding of the plurality of first shields 616 to second printed circuit board 620 may be achieved using any suitable method/structure, including but not limited to press-fit, soldering, surface mount, friction fit, mechanical clamping, and adhesive.

Figure 16A:
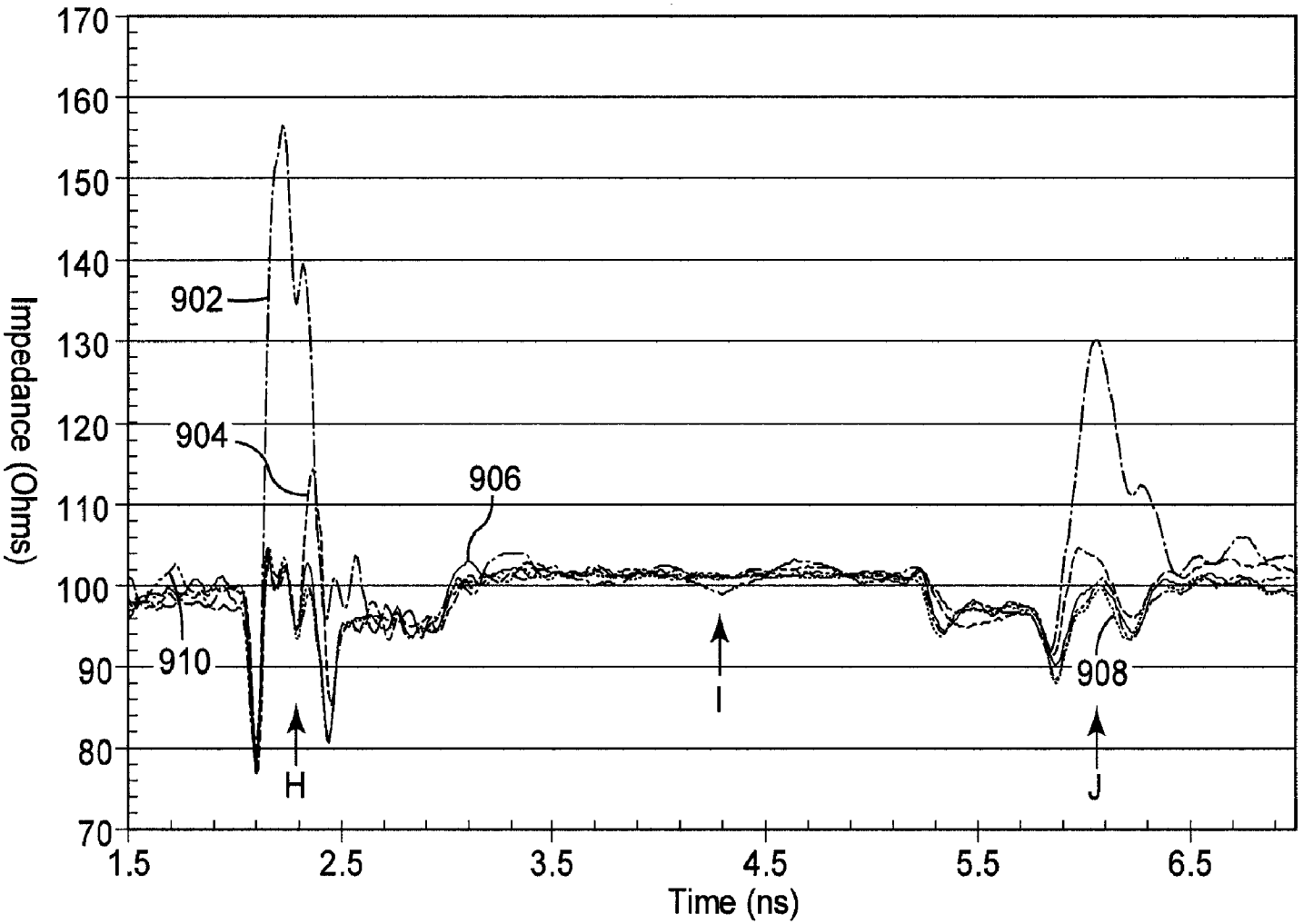
FIGS. 16A-16D are graphs illustrating the improved impedance profile achieved by an electrical connector according to an aspect of the present invention.
Figure 16B:
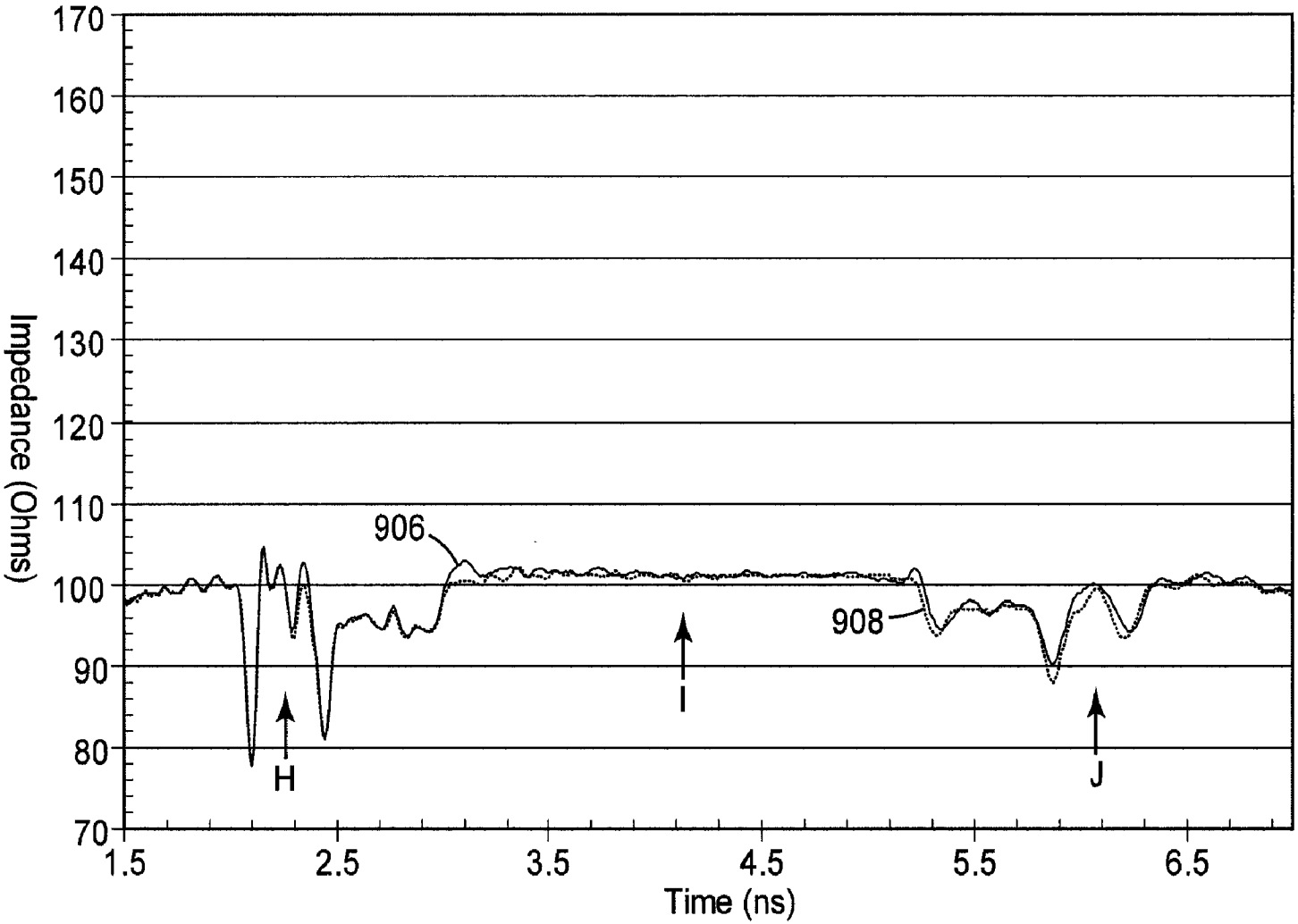
Figure 16C:
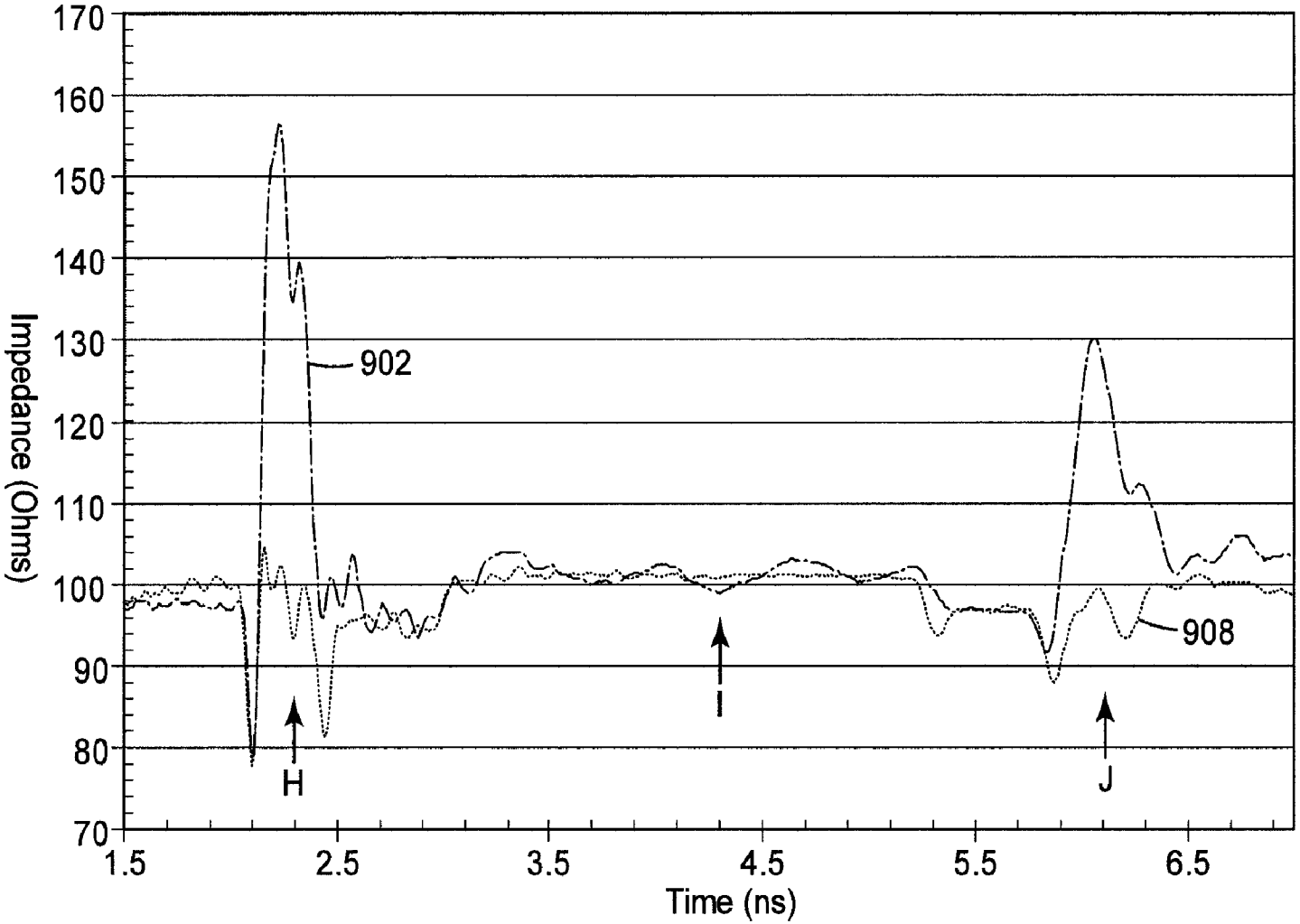
Figure 16D:
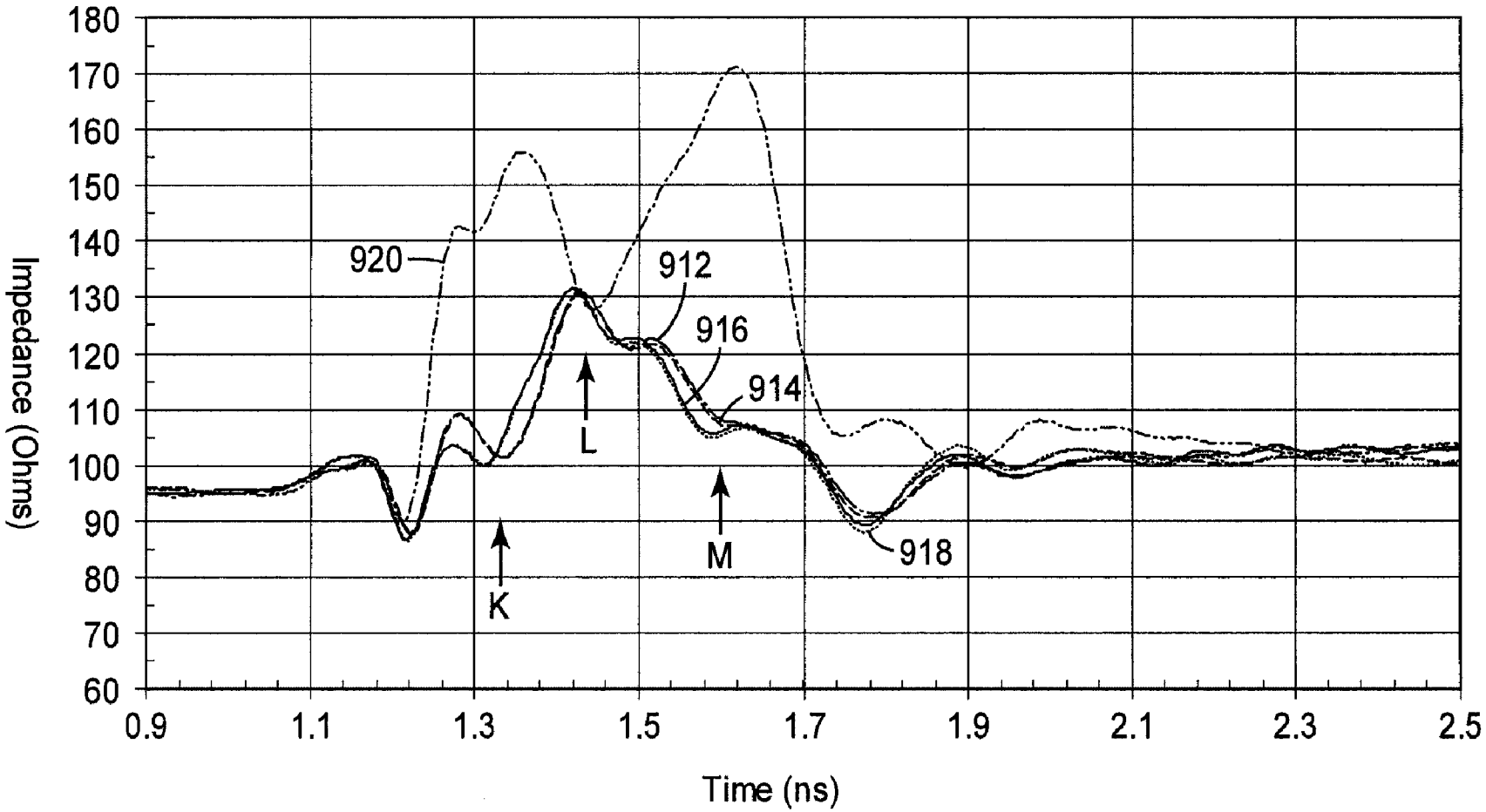

The graphs of FIGS. 16A and 16D illustrate impedance profiles of the exemplary embodiments of an electrical connector with interrupted shielding according to an aspect of the present invention described above and illustrated in FIGS. 2-15.

The graph of FIG. 16A illustrates examples of impedance profiles of electrical connectors with interrupted shielding and impedance profiles of the same electrical connectors with uninterrupted shielding or without shielding. The impedance profiles are measured using an assembly including two electrical connectors electrically connected via an electrical cable such that the signal travels through the first electrical connector (at location H), the electrical cable (at location I), and the second electrical connector (at location J), respectively. Both impedance profiles are measured at an input rise time of about 35 ps. corresponding to a rise time of about 100 ps. at the first connector entry. Details of the impedance profiles illustrated in the graph of FIG. 16A are presented in Table 1 below. Numbers 102, 302 and 602 in Table 1 represent electrical connector 102 (shown in FIGS. 2-5), electrical connector 302 (shown in FIGS. 8 and 9), and electrical connector 602 (shown in FIGS. 14 and 15), respectively.

TABLE 1

| Line | First Electrical Connector | Second Electrical Connector |
|---|---|---|
| 902 | Without Shielding | Without Shielding |
| 904 | 602 - Interrupted Shielding | 602 - Interrupted Shielding |
| 906 | Uninterrupted Shielding | Uninterrupted Shielding |
| 908 | 102 - Interrupted Shielding | 102 - Interrupted Shielding |
| 910 | 302 - Interrupted Shielding | 302 - Interrupted Shielding |

As illustrated in the graph of FIG. 16A, the discontinuities in the impedance profile of an electrical connector with interrupted shielding are unexpectedly smaller than the discontinuities in the impedance profile of the same electrical connector without shielding, and the impedance profile of an electrical connector with interrupted shielding is unexpectedly similar to the impedance profile of the same electrical connector with uninterrupted shielding.

The graph of FIG. 16D illustrates examples of impedance profiles of electrical connectors with interrupted shielding and impedance profiles of the same electrical connectors without shielding. The impedance profiles are measured using an assembly including two electrical connectors electrically connected via a printed circuit board such that the signal travels through the first electrical connector (at location K), the printed circuit board (at location L), and the second electrical connector (at location M), respectively. The impedance profiles are measured at an input rise time of about 35 ps. corresponding to a rise time of about 100 ps. at the first connector entry. Details of the impedance profiles illustrated in the graph of FIG. 16D are presented in Table 2 below. Numbers 502 and 602 in Table 2 represent electrical connector 502 (shown in FIGS. 12 and 13) and electrical connector 602 (shown in FIGS. 14 and 15), respectively.

TABLE 2

| Line | First Electrical Connector | Second Electrical Connector |
|---|---|---|
| 912 | 502 - Interrupted Shielding | 502 - Interrupted Shielding |
| 914 | 502 - Interrupted Shielding | 602 - Interrupted Shielding |
| 916 | 602 - Interrupted Shielding | 502 - Interrupted Shielding |
| 918 | 602 - Interrupted Shielding | 602 - Interrupted Shielding |
| 920 | Without Shielding | Without Shielding |

As illustrated in the graph of FIG. 16D, the discontinuities in the impedance profile of an electrical connector with interrupted shielding are unexpectedly smaller than the discontinuities in the impedance profile of the same electrical connector without shielding.

The information provided in the Tables above and the graphs of FIGS. 16A-16D represent examples and are not intended to limit the scope of the invention described herein.

In each of the embodiments and implementations described herein, the various exemplary embodiments of an electrical connector according to an aspect of the present invention and elements thereof are formed of any suitable material. The materials are selected depending upon the intended application and may include both metals and non-metals (e.g., any one or combination of non-conductive materials including but not limited to polymers, glass, and ceramics). In one embodiment, header body 132, socket housing 122, and insulative elements of third shields 124 and connector modules 126 are formed of a polymeric material by methods such as injection molding, extrusion, casting, machining, and the like, while signal pins 108, ground pins 134, shield blades 110, first shields 116, second shields 128, and conductive elements of third shields 124 and connector modules 126 are formed of metal by methods such as molding, casting, stamping, machining, and the like. Material selection will depend upon factors including, but not limited to, chemical exposure conditions, environmental exposure conditions including temperature and humidity conditions, flame-retardancy requirements, material strength, and rigidity, to name a few.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the mechanical, electromechanical, and electrical arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. An electrical connector comprising:

a header connector including:

a header body formed to include a plurality of first openings and a plurality of second openings;

a plurality of signal pins configured for insertion into the plurality of first openings; and a plurality of shield blades configured for insertion into the plurality of second openings; and a socket connector configured to mate with the header connector and including:

a socket housing;

a plurality of connector modules configured for insertion into the socket housing, each connector module including an insulating material encasing a plurality of conductive paths, each conductive path being coupled to a signal contact; and a plurality of first shields configured for insertion into the socket housing, each first shield extending along a first side of an associated connector module, wherein the plurality of signal pins and the plurality of conductive paths and signal contacts are configured to form a plurality of transmission lines and the plurality of shield blades and the plurality of first shields are electrically connected and configured to provide interrupted shielding of the plurality of transmission lines when the header connector and the socket connector are in a mated configuration.

2. The electrical connector of claim 1, wherein one of the plurality of shield blades and the plurality of first shields are configured to be electrically grounded.

3. The electrical connector of claim 1, wherein the socket connector is configured for mounting to one of a printed circuit board and an electrical cable.

4. The electrical connector of claim 1, wherein the header connector is configured for mounting to one of a printed circuit board and an electrical cable.

5. The electrical connector of claim 1, wherein the plurality of shield blades extend into the socket connector when the header connector and the socket connector are in a mated configuration.

6. The electrical connector of claim 1, wherein one of the plurality of shield blades and the plurality of first shields comprise a plurality of tails configured for engagement with a printed circuit board.

7. A header connector comprising:

a header body formed to include a plurality of first openings and a plurality of second openings;

a plurality of signal pins configured for insertion into the plurality of first openings; and a plurality of shield blades configured for insertion into the plurality of second openings, wherein the plurality of signal pins are configured to cooperate with a plurality of conductive paths and signal contacts of a mating socket connector to form a plurality of transmission lines and the plurality of shield blades are configured to be electrically grounded and provide interrupted shielding of the plurality of transmission lines when the header connector and the socket connector are in a mated configuration, and wherein the plurality of shield blades extend into the socket connector when the header connector and the socket connector are in a mated configuration.

8. The header connector of claim 7, wherein the plurality of shield blades comprise a plurality of tails configured for engagement with a printed circuit board.

9. The header connector of claim 7, wherein each of the plurality of shield blades includes at a first end thereof a generally right angle shielding portion configured to be disposed adjacent to a corresponding one of the plurality of signal pins.

10. The header connector of claim 9, wherein the first and second openings are arranged in the header body such that the generally right angle shielding portions of the plurality of shield blades substantially surround the plurality of signal pins to form a coaxial shield around each of the plurality of signal pins.

11. The header connector of claim 9, wherein the generally right angle shielding portion includes first and second leg portions, wherein each of the plurality of second openings includes a generally right angle second opening for receiving the generally right angle shielding portion and having first and second narrow throat portions dimensioned to engage the first and second leg portions to hold the shield blade in place and having a central portion coupled to first and second end portions by the first and second narrow throat portions, and wherein the central portion and the first and second end portions are shaped to provide an air gap surrounding the generally right angle shielding portion.

12. The header connector of claim 7, wherein the plurality of signal pins and the plurality of shield blades are retained in the header body by press-fit.

13. The header connector of claim 7, wherein the plurality of shield blades are formed in a continuous strip of material and are configured to be electrically connected to a common ground.

14. A socket connector comprising:

a socket housing;

a plurality of connector modules configured for insertion into the socket housing, each connector module including an insulating material encasing a plurality of conductive paths, each conductive path being coupled to a signal contact; and a plurality of first shields configured for insertion into the socket housing, each first shield extending along a first side of an associated connector module, wherein the plurality of conductive paths and signal contacts are configured to cooperate with a plurality of signal pins of a mating header connector to form a plurality of transmission lines and the plurality of first shields are configured to be electrically grounded and provide interrupted shielding of the plurality of transmission lines when the socket connector and the header connector are in a mated configuration.

15. The socket connector of claim 14, wherein the plurality of first shields comprise a plurality of tails configured for engagement with a printed circuit board.

16. The socket connector of claim 14, wherein individual first shields are removable to form differential pairs of conductive paths in adjacent rows.

17. The socket connector of claim 14, wherein the connector modules include a plurality of passageways which are interleaved with the plurality of conductive paths and extend laterally between opposite sides of the connector modules, and wherein the first shields include a plurality of passageways extending laterally between opposite sides thereof in substantial alignment with the passageways in the connector modules to form a plurality of laterally extending channels, the socket connector further comprising a plurality of second shields configured for insertion into the plurality of laterally extending channels and electrically coupled to the first shields to form a coaxial shield around each conductive path.

18. The socket connector of claim 17, wherein individual second shields are removable to form differential pairs of conductive paths in adjacent columns.

19. The socket connector of claim 17 further comprising a plurality of third shields configured for insertion into the socket housing, wherein the plurality of third shields are electrically coupled to the first shields to form a coaxial shield around each signal contact.

20. The socket connector of claim 19, wherein individual third shields are removable along with individual second shields to form differential pairs of conductive paths in adjacent columns.

* * * * *

UNITED STATES PATENT AND TRADEMARK OFFICE

CERTIFICATE OF CORRECTION

PATENT NO. : 7,621,760 B1
APPLICATION NO. : 12/334301
DATED : November 24, 2009
INVENTOR(S) : Alexander W. Barr It is certified that error appears in the above-identified patent and that said Letters Patent is hereby corrected as shown below:

Title page, item (*) Notice: should read as follows: Subject to any disclaimer, the term of this patent is extended or adjusted under 35 U.S.C. 154(b) by 0 days.

Column 12,
Lines 46-47, delete "electromechanical," and insert --electro-mechanical,-- therefor.

Signed and Sealed this

Seventeenth Day of August, 2010

David J. Kappos

David J. Kappos
*Director of the United States Patent and Trademark Office*